US008893347B2

(12) United States Patent
Przepasniak

(10) Patent No.: US 8,893,347 B2
(45) Date of Patent: Nov. 25, 2014

(54) CLEANING OR DUSTING PAD WITH ATTACHMENT MEMBER HOLDER

(71) Applicant: S.C. Johnson & Son, Inc., Racine, WI (US)

(72) Inventor: Ann Marie Przepasniak, Sturtevant, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 160 days.

(21) Appl. No.: 13/959,895

(22) Filed: Aug. 6, 2013

(65) Prior Publication Data

US 2013/0340191 A1 Dec. 26, 2013

Related U.S. Application Data

(62) Division of application No. 12/449,410, filed on Aug. 6, 2009, now Pat. No. 8,528,151.

(60) Provisional application No. 60/888,481, filed on Feb. 6, 2007.

(51) Int. Cl.

| | |
|---|---|
| ***A47L 13/12*** | (2006.01) |
| ***A47L 13/20*** | (2006.01) |
| ***A47L 13/38*** | (2006.01) |
| ***A47L 13/16*** | (2006.01) |

(52) U.S. Cl.

CPC *A47L 13/16* (2013.01); *A47L 13/38* (2013.01)
USPC ..... 15/229.3; 15/226; 15/229.4; 300/21

(58) Field of Classification Search

USPC ..... 300/21; 15/226, 229.3, 229.4
See application file for complete search history.

(56) References Cited

U.S. PATENT DOCUMENTS

| | | | |
|---|---|---|---|
| 781,814 | A | 2/1905 | D'Ossone |
| 782,669 | A | 2/1905 | Lea |
| 1,230,476 | A | 6/1917 | Gilmore |
| 1,250,150 | A | 12/1917 | DuBois |
| 1,313,184 | A | 8/1919 | Hayden |
| 1,416,480 | A | 5/1922 | Leatherman |
| 1,514,990 | A | 11/1924 | Plunkett |

(Continued)

FOREIGN PATENT DOCUMENTS

| | | | |
|---|---|---|---|
| CA | 2384357 | A1 | 3/2002 |
| CA | 2492582 | A1 | 1/2004 |

(Continued)

OTHER PUBLICATIONS

International Search Report for International application No. PCT/US2008001502, International filing date is Feb. 5, 2008.

(Continued)

*Primary Examiner* — Randall Chin

(57) ABSTRACT

A cleaning pad or cleaning article is disclosed. The cleaning article includes a combination of fibers bonded to a base sheet. Spot-bonding regions and/or a central joining line join fibers to the base sheet. The base sheet further has an attachment portion for retaining the cleaning pad to a cleaning implement handle. In one embodiment, the attachment portion is comprised of elongate slit openings in the base sheet. In other embodiments, the base sheet is folded over and bonded to the base sheet or to itself to form a retaining cavity for an attachment member.

7 Claims, 16 Drawing Sheets

(56) References Cited

U.S. PATENT DOCUMENTS 1,722,162 A 7/1926 Teetsell
1,637,595 A 8/1927 Sturgis
1,804,415 A 5/1931 Hales
2,037,135 A 4/1936 Johnson et al.
2,047,199 A 7/1936 Gewalt
2,068,162 A 1/1937 Borchers
2,147,769 A 2/1939 Leatherman
2,151,425 A 3/1939 Gregory
2,262,888 A 11/1941 Dodge
2,755,498 A 7/1956 Park
2,862,217 A 12/1958 Small et al.
2,935,754 A 5/1960 Abdo
3,066,344 A 12/1962 Garcia Borras et al.
3,406,694 A 10/1968 Odence
3,495,918 A 2/1970 Leland
3,965,518 A 6/1976 Muoio
3,979,163 A 9/1976 Beard
4,254,738 A 3/1981 Stanley
4,298,649 A 11/1981 Meitner
4,309,469 A 1/1982 Varona
4,313,774 A 2/1982 Arthur
4,364,144 A 12/1982 Moss et al.
4,376,147 A 3/1983 Byrne et al.
4,377,615 A 3/1983 Suzuki et al.
D268,967 S 5/1983 Sami
D268,968 S 5/1983 Sami
4,426,417 A 1/1984 Meitner et al.
4,432,472 A 2/1984 Lamm
4,436,780 A 3/1984 Hotchkiss et al.
4,469,734 A 9/1984 Minto et al.
4,469,735 A 9/1984 Trokhan
4,473,918 A 10/1984 Moss et al.
4,487,795 A 12/1984 Yasuda et al.
4,510,640 A 4/1985 Omori
4,546,029 A 10/1985 Cancio et al.
4,601,938 A 7/1986 Deacon et al.
4,609,518 A 9/1986 Curro et al.
4,623,575 A 11/1986 Brooks et al.
4,666,621 A 5/1987 Clark et al.
4,685,167 A 8/1987 Murray
4,705,420 A 11/1987 Bokmiller et al.
4,710,185 A 12/1987 Snevd, Jr. et al.
4,713,274 A 12/1987 Minor
4,776,716 A 10/1988 Huang
4,788,735 A 12/1988 Fuk Fan
4,802,782 A 2/1989 Scalf
4,806,037 A 2/1989 Berglund
4,829,622 A 5/1989 O'Sullivan
4,859,519 A 8/1989 Cabe, Jr. et al.
4,906,513 A 3/1990 Kebbell et al.
4,926,515 A 5/1990 Lynn et al.
4,954,001 A 9/1990 Billat
4,983,060 A 1/1991 Steinbach
4,991,362 A 2/1991 Heyer et al.
4,995,133 A 2/1991 Newell et al.
5,039,431 A 8/1991 Johnson et al.
5,062,729 A 11/1991 Yamamoto
5,071,489 A 12/1991 Silvenis et al.
5,141,348 A 8/1992 'tartt
5,143,774 A 9/1992 Cancio et al.
5,229,191 A 7/1993 Austin
5,427,838 A 6/1995 Yamamoto et al.
5,429,854 A 7/1995 Currie et al.
5,452,491 A 9/1995 Thompson
5,466,318 A 11/1995 Bjork
5,477,582 A 12/1995 Yamashita
5,525,397 A 6/1996 Shizuno et al.
5,572,763 A 11/1996 Equchi
5,573,719 A 11/1996 Fitting
5,603,139 A 2/1997 Alazet
5,613,263 A 3/1997 Nolte
5,715,560 A 2/1998 Banicki
D391,711 S 3/1998 Hanaoka et al.
5,722,966 A 3/1998 Christon et al.
5,735,620 A 4/1998 Ford
5,769,324 A 6/1998 Lenhart
5,779,155 A 7/1998 Schennum et al.
5,815,878 A 10/1998 Murakami et al.
5,839,150 A 11/1998 Miyaoka
5,842,488 A 12/1998 Belleau et al.
5,845,361 A 12/1998 Murakami et al.
5,865,551 A 2/1999 Lalli et al.
5,888,006 A 3/1999 Ping et al.
5,895,504 A 4/1999 Sramek et al.
5,908,255 A 6/1999 Branch
5,953,784 A 9/1999 Suzuki et al.
5,958,555 A 9/1999 Takeuchi et al.
5,960,508 A 10/1999 Holt et al.
5,962,112 A 10/1999 Haynes et al.
5,980,673 A 11/1999 Takeuchi et al.
6,013,349 A 1/2000 Takeuchi et al.
6,045,622 A 4/2000 Holt et al.
6,047,435 A 4/2000 Suzuki et al.
6,054,202 A 4/2000 Takeuchi et al.
6,119,298 A 9/2000 Kenmochi et al.
6,142,750 A 11/2000 Benecke
6,143,393 A 11/2000 Abe et al.
6,202,246 B1 3/2001 Boucher
6,202,250 B1 3/2001 Kenmochi et al.
6,206,058 B1 3/2001 Nagel et al.
6,241,835 B1 6/2001 Abe et al.
6,245,413 B1 6/2001 Kenmochi et al.
6,298,517 B1 10/2001 McKay
6,305,046 B1 10/2001 Kingry et al.
6,309,731 B1 10/2001 Takeuchi et al.
6,315,478 B1 11/2001 Atkins
6,329,308 B1 12/2001 Kenmochi et al.
6,346,506 B1 2/2002 Julemont
6,361,638 B2 3/2002 Takai et al.
6,405,403 B1 6/2002 McKay
6,406,206 B1 6/2002 Girardot et al.
6,475,976 B1 11/2002 Mahieu et al.
6,506,472 B1 1/2003 Tanaka et al.
6,513,184 B1 2/2003 Brown et al.
6,540,424 B1 4/2003 Hall et al.
6,550,092 B1 4/2003 Brown et al.
6,551,001 B2 4/2003 Aberegg et al.
6,554,937 B1 4/2003 Kenmochi et al.
6,557,178 B1 5/2003 Hoover
6,569,828 B1 5/2003 Thomas et al.
6,572,602 B2 6/2003 Furuya et al.
6,613,729 B1 9/2003 Cole et al.
6,651,290 B2 11/2003 Kingry et al.
6,669,391 B2 12/2003 Policicchio et al.
6,672,313 B2 1/2004 Battaglia et al.
6,681,434 B2 1/2004 Smith
6,687,942 B1 2/2004 Pembler
6,687,944 B2 2/2004 Young
6,716,514 B2 4/2004 Nissing
6,722,806 B2 4/2004 Kunkler et al.
6,742,717 B2 6/2004 Aberegg et al.
6,742,951 B2 6/2004 Schultz et al.
6,750,187 B2 6/2004 Alam et al.
6,758,412 B2 7/2004 Aberegg et al.
6,777,064 B1 8/2004 Brown et al.
6,790,794 B2 9/2004 Fereshtehkhou et al.
6,794,351 B2 9/2004 Shick et al.
6,797,400 B2 9/2004 Weuthen et al.
6,807,702 B2 10/2004 Keck et al.
6,810,554 B2 11/2004 McKay
6,813,801 B2 11/2004 Tanaka et al.
6,815,502 B1 11/2004 Lang et al.
6,828,014 B2 12/2004 Braham et al.
6,828,290 B1 12/2004 Evers et al.
6,835,678 B2 12/2004 Jackson et al.
6,844,308 B1 1/2005 Dastbaz et al.
6,851,881 B2 2/2005 Slaboden
6,855,790 B2 2/2005 Chang et al.
6,887,807 B1 5/2005 Matsushita et al.
6,953,299 B2 10/2005 Wang et al.
6,960,042 B1 11/2005 Hsiao
6,968,591 B2 11/2005 Tanaka
7,803,726 B2 * 9/2010 Policicchio et al. ..... 442/123
7,870,635 B2 * 1/2011 Yamada ..... 15/230

(56) References Cited

U.S. PATENT DOCUMENTS

| | | | |
|---|---|---|---|
| 2002/0132098 | A1 | 9/2002 | Miyazawa et al. |
| 2002/0147122 | A1 | 10/2002 | Shick et al. |
| 2002/0148061 | A1 | 10/2002 | Tanaka et al. |
| 2003/0000039 | A1 | 1/2003 | Borcherds |
| 2003/0003832 | A1 | 1/2003 | Childs et al. |
| 2003/0044569 | A1 | 3/2003 | Kacher et al. |
| 2003/0074756 | A1 | 4/2003 | Policicchio et al. |
| 2003/0106568 | A1 | 6/2003 | Keck et al. |
| 2003/0110584 | A1 | 6/2003 | Clare et al. |
| 2003/0119705 | A1 | 6/2003 | Barnabas et al. |
| 2003/0126710 | A1 | 7/2003 | Policicchio et al. |
| 2003/0159223 | A1 | 8/2003 | Plankenhorn |
| 2003/0180083 | A1 | 9/2003 | Hall et al. |
| 2003/0182751 | A1 | 10/2003 | White |
| 2003/0194259 | A1 | 10/2003 | Kunkler et al. |
| 2003/0200991 | A1 | 10/2003 | Keck et al. |
| 2003/0211802 | A1 | 11/2003 | Keck et al. |
| 2003/0216272 | A1 | 11/2003 | Sherry et al. |
| 2003/0233718 | A1 | 12/2003 | Heathcock et al. |
| 2003/0235463 | A1 | 12/2003 | Neumann et al. |
| 2004/0016074 | A1 | 1/2004 | Tanaka |
| 2004/0022575 | A1 | 2/2004 | Hall et al. |
| 2004/0034956 | A1 | 2/2004 | Tanaka et al. |
| 2004/0086320 | A1 | 5/2004 | Policicchio et al. |
| 2004/0088808 | A1 | 5/2004 | Vitantionio et al. |
| 2004/0093678 | A1 | 5/2004 | Hart et al. |
| 2004/0111817 | A1 | 6/2004 | Chen et al. |
| 2004/0141797 | A1 | 7/2004 | Garabedian et al. |
| 2004/0141798 | A1 | 7/2004 | Garabedian et al. |
| 2004/0144406 | A1 | 7/2004 | Garabedian et al. |
| 2004/0147425 | A1 | 7/2004 | Castro et al. |
| 2004/0178224 | A1 | 9/2004 | Fahy et al. |
| 2004/0184867 | A1 | 9/2004 | Wang et al. |
| 2004/0204332 | A1 | 10/2004 | Dastbaz et al. |
| 2004/0204333 | A1 | 10/2004 | Dobrin et al. |
| 2004/0216771 | A1 | 11/2004 | Hall et al. |
| 2004/0226123 | A1 | 11/2004 | Policicchio et al. |
| 2005/0000050 | A1 | 1/2005 | Galvin et al. |
| 2005/0004546 | A1 | 1/2005 | Mizutani et al. |
| 2005/0016035 | A1 | 1/2005 | Kobavashi et al. |
| 2005/0034255 | A1 | 2/2005 | Svendsen |
| 2005/0039285 | A1 | 2/2005 | Tanaka et al. |
| 2005/0076936 | A1 | 4/2005 | Pung et al. |
| 2005/0079987 | A1 | 4/2005 | Cartwright et al. |
| 2005/0081888 | A1 | 4/2005 | Pung et al. |
| 2005/0085407 | A1 | 4/2005 | Oldenhove et al. |
| 2005/0097691 | A1 | 5/2005 | Tsuchiva et al. |
| 2005/0097695 | A1 | 5/2005 | Tanaka et al. |
| 2005/0097696 | A1 | 5/2005 | Tanaka et al. |
| 2005/0102781 | A1 | 5/2005 | Tsuchiva et al. |
| 2005/0113277 | A1 | 5/2005 | Sherry et al. |
| 2005/0132521 | A1 | 6/2005 | Tanaka et al. |
| 2005/0133174 | A1 | 6/2005 | Gorley et al. |
| 2005/0144747 | A1 | 7/2005 | Juan |
| 2005/0148264 | A1 | 7/2005 | Varona et al. |
| 2005/0150784 | A1 | 7/2005 | Sanchez et al. |
| 2005/0155628 | A1 | 7/2005 | Kilkenney et al. |
| 2005/0155630 | A1 | 7/2005 | Kilkenney et al. |
| 2005/0155631 | A1 | 7/2005 | Kilkenney et al. |
| 2005/0172440 | A1 | 8/2005 | Lin |
| 2005/0177967 | A1 | 8/2005 | Tanaka et al. |
| 2005/0188490 | A1 | 9/2005 | Tanaka et al. |
| 2005/0193513 | A1 | 9/2005 | Tanaka et al. |
| 2005/0193514 | A1 | 9/2005 | Tanaka et al. |
| 2005/0198760 | A1 | 9/2005 | Tanaka et al. |
| 2005/0202190 | A1 | 9/2005 | Ledger et al. |
| 2005/0221070 | A1 | 10/2005 | Bando et al. |

FOREIGN PATENT DOCUMENTS

| | | | |
|---|---|---|---|
| DE | 1726919 | | 7/1956 |
| DE | 29516181 | | 10/1995 |
| DE | 29701349 | | 1/1997 |
| DE | 19630522 | A1 | 2/1998 |
| EP | 0097036 | A2 | 12/1983 |
| EP | 0399495 | A1 | 11/1990 |
| EP | 0468301 | A1 | 1/1992 |
| EP | 0848927 | A1 | 6/1998 |
| EP | 0863240 | A1 | 9/1998 |
| EP | 0872206 | B1 | 7/2000 |
| EP | 1095763 | A1 | 5/2001 |
| EP | 1147734 | A1 | 10/2001 |
| EP | 0986322 | B1 | 12/2001 |
| EP | 1021121 | B1 | 6/2002 |
| EP | 1211342 | A1 | 6/2002 |
| EP | 1212972 | A2 | 6/2002 |
| EP | 1222915 | A2 | 7/2002 |
| EP | 1266957 | | 12/2002 |
| EP | 0865755 | B1 | 5/2003 |
| EP | 1314390 | A1 | 5/2003 |
| EP | 0983014 | B1 | 12/2003 |
| EP | 1213230 | B1 | 1/2005 |
| EP | 1498028 | A1 | 1/2005 |
| EP | 1250220 | B1 | 4/2005 |
| EP | 1523919 | A1 | 4/2005 |
| EP | 1523920 | A1 | 4/2005 |
| EP | 1523921 | A2 | 4/2005 |
| EP | 1523922 | A2 | 4/2005 |
| EP | 1523923 | A2 | 4/2005 |
| EP | 1523924 | A2 | 4/2005 |
| EP | 1523925 | A2 | 4/2005 |
| EP | 1537819 | A2 | 6/2005 |
| EP | 1547513 | A2 | 6/2005 |
| EP | 1302146 | B1 | 7/2005 |
| EP | 1550395 | A2 | 7/2005 |
| EP | 1552890 | A1 | 7/2005 |
| EP | 1554967 | A2 | 7/2005 |
| EP | 1566135 | A1 | 8/2005 |
| EP | 1591053 | A1 | 11/2005 |
| EP | 1591575 | A1 | 11/2005 |
| EP | 1656876 | | 5/2006 |
| EP | 1723885 | | 11/2006 |
| EP | 1731076 | | 12/2006 |
| ES | 2013349 | | 5/1990 |
| FR | 832463 | | 9/1938 |
| GB | 907102 | | 10/1962 |
| GB | 2369560 | A | 6/2002 |
| GB | 2395680 | A | 6/2004 |
| GB | 2414654 | A | 12/2005 |
| JP | 39-6833 | | 3/1939 |
| JP | 56-145466 | | 11/1981 |
| JP | 58-194770 | | 12/1983 |
| JP | 60-63157 | | 5/1985 |
| JP | 60-63158 | | 5/1985 |
| JP | 60-63175 | | 5/1985 |
| JP | 62-47351 | | 3/1987 |
| JP | 2-4541 | | 1/1990 |
| JP | 04250130 | A | 9/1992 |
| JP | 04288113 | A | 10/1992 |
| JP | 04312430 | A | 11/1992 |
| JP | 05025763 | | 2/1993 |
| JP | 05056902 | A | 3/1993 |
| JP | 05115403 | A | 5/1993 |
| JP | 05192285 | A | 8/1993 |
| JP | 05245090 | A | 9/1993 |
| JP | 05285435 | A | 11/1993 |
| JP | 05-95457 | | 12/1993 |
| JP | 06014858 | A | 1/1994 |
| JP | 06014859 | A | 1/1994 |
| JP | 06017356 | | 1/1994 |
| JP | 06162712 | A | 6/1994 |
| JP | 06182310 | A | 7/1994 |
| JP | 07011269 | A | 1/1995 |
| JP | 07067821 | A | 3/1995 |
| JP | 07169098 | A | 7/1995 |
| JP | 08043272 | A | 2/1996 |
| JP | 08092530 | A | 4/1996 |
| JP | 08133290 | A | 5/1996 |
| JP | 08187210 | A | 7/1996 |
| JP | 08243065 | A | 9/1996 |
| JP | 08291456 | A | 11/1996 |
| JP | 08293180 | A | 11/1996 |
| JP | 08297949 | A | 11/1996 |

(56) References Cited

FOREIGN PATENT DOCUMENTS

| | | | |
|---|---|---|---|
| JP | 08302314 | A | 11/1996 |
| JP | 08302550 | A | 11/1996 |
| JP | 08336493 | | 12/1996 |
| JP | 09038009 | A | 2/1997 |
| JP | 09047416 | | 2/1997 |
| JP | 9047416 | | 2/1997 |
| JP | 09055055 | A | 2/1997 |
| JP | 09055056 | A | 2/1997 |
| JP | 09098920 | | 4/1997 |
| JP | 09131288 | | 5/1997 |
| JP | 09135798 | | 5/1997 |
| JP | 09140650 | A | 6/1997 |
| JP | 09154519 | A | 6/1997 |
| JP | 09154791 | A | 6/1997 |
| JP | 09188950 | A | 7/1997 |
| JP | 09224895 | | 9/1997 |
| JP | 09253017 | | 9/1997 |
| JP | 09255679 | | 9/1997 |
| JP | 09271459 | | 10/1997 |
| JP | 09273061 | A | 10/1997 |
| JP | 09276193 | | 10/1997 |
| JP | 09319305 | A | 12/1997 |
| JP | 09324354 | | 12/1997 |
| JP | 10005159 | A | 1/1998 |
| JP | 10005164 | A | 1/1998 |
| JP | 10033170 | A | 2/1998 |
| JP | 10033343 | A | 2/1998 |
| JP | 10033443 | A | 2/1998 |
| JP | 10043115 | A | 2/1998 |
| JP | 10099246 | A | 4/1998 |
| JP | 10127547 | A | 5/1998 |
| JP | 10137168 | | 5/1998 |
| JP | 10146306 | A | 6/1998 |
| JP | 10203542 | A | 8/1998 |
| JP | 10216060 | A | 8/1998 |
| JP | 10235574 | A | 9/1998 |
| JP | 10237235 | A | 9/1998 |
| JP | 10245756 | | 9/1998 |
| JP | 10262888 | A | 10/1998 |
| JP | 10276953 | | 10/1998 |
| JP | 10286206 | | 10/1998 |
| JP | 10286209 | | 10/1998 |
| JP | 10328107 | | 12/1998 |
| JP | 11000295 | A | 1/1999 |
| JP | 11019015 | | 1/1999 |
| JP | 11089776 | A | 4/1999 |
| JP | 11156979 | | 6/1999 |
| JP | 11156980 | | 6/1999 |
| JP | 11156981 | | 6/1999 |
| JP | 11241099 | A | 9/1999 |
| JP | 11269750 | | 10/1999 |
| JP | 11276401 | | 10/1999 |
| JP | 11276402 | | 10/1999 |
| JP | 11302688 | A | 11/1999 |
| JP | 11318789 | A | 11/1999 |
| JP | 11332777 | A | 12/1999 |
| JP | 11332778 | A | 12/1999 |
| JP | 2000034663 | A | 2/2000 |
| JP | 2000083883 | | 3/2000 |
| JP | 2000166841 | | 6/2000 |
| JP | 2000210238 | A | 8/2000 |
| JP | 2000212879 | | 8/2000 |
| JP | 2000245670 | | 9/2000 |
| JP | 2000254088 | A | 9/2000 |
| JP | 2000254089 | A | 9/2000 |
| JP | 2000296084 | | 10/2000 |
| JP | 2001003094 | A | 1/2001 |
| JP | 2001059098 | A | 3/2001 |
| JP | 2001190487 | A | 7/2001 |
| JP | 2001198065 | A | 7/2001 |
| JP | 2001198066 | A | 7/2001 |
| JP | 2001269300 | A | 10/2001 |
| JP | 2001275875 | A | 10/2001 |
| JP | 2001299658 | A | 10/2001 |
| JP | 2001299659 | A | 10/2001 |
| JP | 2001310168 | A | 11/2001 |
| JP | 2001354238 | A | 12/2001 |
| JP | 2002000645 | A | 1/2002 |
| JP | 2002119451 | A | 4/2002 |
| JP | 2002119929 | A | 4/2002 |
| JP | 2002145367 | A | 5/2002 |
| JP | 2002165742 | | 6/2002 |
| JP | 2002191536 | A | 7/2002 |
| JP | 2002233486 | A | 8/2002 |
| JP | 2002240179 | A | 8/2002 |
| JP | 2002253459 | A | 9/2002 |
| JP | 2002306389 | A | 10/2002 |
| JP | 2002315704 | A | 10/2002 |
| JP | 2002363509 | A | 12/2002 |
| JP | 2002369783 | A | 12/2002 |
| JP | 2003000234 | A | 1/2003 |
| JP | 2003024254 | A | 1/2003 |
| JP | 2003111701 | A | 4/2003 |
| JP | 2003111703 | A | 4/2003 |
| JP | 2003111704 | A | 4/2003 |
| JP | 2003164402 | A | 6/2003 |
| JP | 2003164407 | A | 6/2003 |
| JP | 2003164408 | A | 6/2003 |
| JP | 2003190074 | A | 7/2003 |
| JP | 2003199698 | A | 7/2003 |
| JP | 2003204911 | A | 7/2003 |
| JP | 2003238394 | A | 8/2003 |
| JP | 2003261899 | A | 9/2003 |
| JP | 2003265387 | A | 9/2003 |
| JP | 2003265391 | A | 9/2003 |
| JP | 2003284660 | A | 10/2003 |
| JP | 2003319898 | A | 11/2003 |
| JP | 2004033237 | A | 2/2004 |
| JP | 2004033238 | A | 2/2004 |
| JP | 2004049605 | A | 2/2004 |
| JP | 2004057242 | A | 2/2004 |
| JP | 2004057244 | A | 2/2004 |
| JP | 2004065387 | A | 3/2004 |
| JP | 2004089288 | A | 3/2004 |
| JP | 2004141369 | A | 5/2004 |
| JP | 2004167274 | A | 6/2004 |
| JP | 2004208917 | A | 7/2004 |
| JP | 2004208939 | A | 7/2004 |
| JP | 2004208941 | A | 7/2004 |
| JP | 2004223022 | A | 8/2004 |
| JP | 2004223692 | A | 8/2004 |
| JP | 2004237023 | A | 8/2004 |
| JP | 2004275605 | A | 10/2004 |
| JP | 2004298650 | A | 10/2004 |
| JP | 2004351070 | A | 12/2004 |
| JP | 2005006778 | A | 1/2005 |
| JP | 2005007094 | A | 1/2005 |
| JP | 2005021709 | A | 1/2005 |
| JP | 2005040641 | A1 | 2/2005 |
| JP | 2005046645 | A | 2/2005 |
| JP | 2005087506 | A | 4/2005 |
| JP | 2005095643 | A | 4/2005 |
| JP | 2005095665 | A | 4/2005 |
| JP | 2005111284 | A | 4/2005 |
| JP | 2005118392 | A | 5/2005 |
| JP | 2005124857 | A | 5/2005 |
| JP | 2005131422 | A | 5/2005 |
| JP | 2005137603 | A | 6/2005 |
| JP | 2005137929 | A | 6/2005 |
| JP | 2005137930 | A | 6/2005 |
| JP | 2005137931 | A | 6/2005 |
| JP | 2005143523 | A | 6/2005 |
| JP | 2005144111 | A | 6/2005 |
| JP | 2005144198 | A | 6/2005 |
| JP | 2005144199 | A | 6/2005 |
| JP | 2005160721 | A | 6/2005 |
| JP | 2005168711 | A | 6/2005 |
| JP | 2005169096 | A | 6/2005 |
| JP | 2005169148 | A | 6/2005 |
| JP | 2005199077 | A | 7/2005 |
| WO | 97/49326 | | 12/1997 |
| WO | 98/52485 | | 11/1998 |
| WO | 99/07272 | | 2/1999 |
| WO | 99/07273 | | 2/1999 |

(56) References Cited

FOREIGN PATENT DOCUMENTS

| | | | |
|---|---|---|---|
| WO | 99/23291 | | 5/1999 |
| WO | 99/37842 | | 7/1999 |
| WO | 00/53407 | | 9/2000 |
| WO | 01/22861 | A2 | 4/2001 |
| WO | 01/40558 | A2 | 6/2001 |
| WO | 01/41622 | A2 | 6/2001 |
| WO | 01/45616 | A1 | 6/2001 |
| WO | 01/52713 | A2 | 7/2001 |
| WO | 01/71081 | A1 | 9/2001 |
| WO | 01/80705 | A2 | 11/2001 |
| WO | 01/85452 | A1 | 11/2001 |
| WO | 01/92622 | A1 | 12/2001 |
| WO | 02/00819 | A1 | 1/2002 |
| WO | 02/03847 | A2 | 1/2002 |
| WO | 02/34101 | A1 | 5/2002 |
| WO | 02/38027 | A2 | 5/2002 |
| WO | 02/38846 | A2 | 5/2002 |
| WO | 02/41745 | A1 | 5/2002 |
| WO | 02/43536 | A2 | 6/2002 |
| WO | 02/45564 | A2 | 6/2002 |
| WO | 02/49496 | A1 | 6/2002 |
| WO | 02/053694 | A1 | 7/2002 |
| WO | 02/065887 | A1 | 8/2002 |
| WO | 02/087327 | A1 | 11/2002 |
| WO | 02/091900 | A1 | 11/2002 |
| WO | 02/102221 | A1 | 12/2002 |
| WO | 03/000165 | A1 | 1/2003 |
| WO | 03/001962 | A1 | 1/2003 |
| WO | 03/004748 | A1 | 1/2003 |
| WO | 03/039321 | A1 | 5/2003 |
| WO | 03/050224 | A1 | 6/2003 |
| WO | 03/059139 | A1 | 7/2003 |
| WO | 03/070080 | A1 | 8/2003 |
| WO | 03/093557 | A1 | 11/2003 |
| WO | 03/099517 | A1 | 12/2003 |
| WO | 2004008931 | | 1/2004 |
| WO | 2004020725 | A1 | 3/2004 |
| WO | 2004022832 | A1 | 3/2004 |
| WO | 2004044298 | A1 | 5/2004 |
| WO | 2004048047 | A1 | 6/2004 |
| WO | 2004060130 | A1 | 7/2004 |
| WO | 2004061185 | A1 | 7/2004 |
| WO | 2004061187 | A1 | 7/2004 |
| WO | 2004062821 | | 7/2004 |
| WO | 2004064590 | A2 | 8/2004 |
| WO | 2004073479 | A2 | 9/2004 |
| WO | 2005002842 | A1 | 1/2005 |
| WO | 2005065517 | A2 | 7/2005 |
| WO | 2005084515 | | 9/2005 |
| WO | 2005099552 | A2 | 10/2005 |
| WO | 2005100520 | A1 | 10/2005 |
| WO | 2005100521 | A1 | 10/2005 |
| WO | 2005100523 | A1 | 10/2005 |
| WO | 2005100526 | A1 | 10/2005 |
| WO | 2005100527 | A1 | 10/2005 |
| WO | 2005103217 | A1 | 11/2005 |
| WO | 2005103218 | A1 | 11/2005 |
| WO | 2005103244 | A1 | 11/2005 |
| WO | 2005103354 | A1 | 11/2005 |
| WO | 2005103355 | A1 | 11/2005 |
| WO | 2006121802 | A2 | 11/2006 |
| WO | 2007058901 | | 5/2007 |
| WO | WO2007058901 | | 5/2007 |

OTHER PUBLICATIONS

International Search Report for International application No. PCT/US2008001502, International filing date is Feb. 15, 2008.

PCT/US2007/013269 International Search Report and Written Opinion dated Feb. 26, 2008 (J4512A).

PCT/US2007/000601 International Search Report and Written Opinion dated Jul. 3, 2007.

* cited by examiner

FIG. 6C
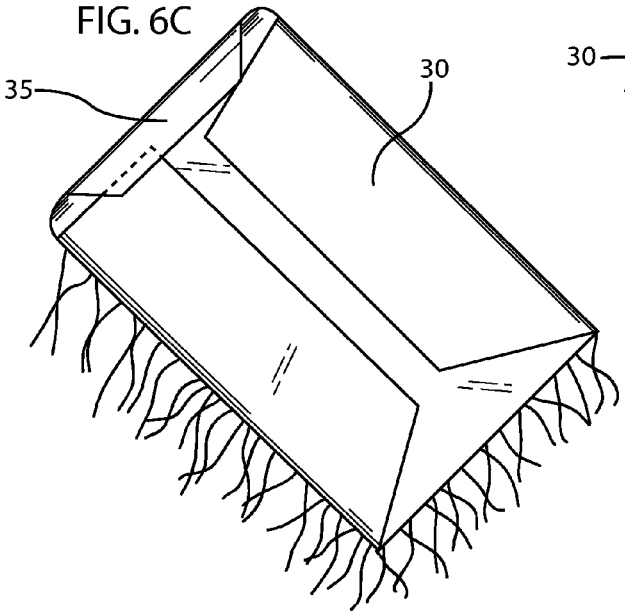
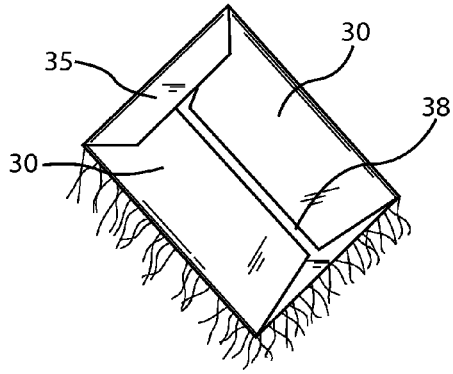
FIG. 6E
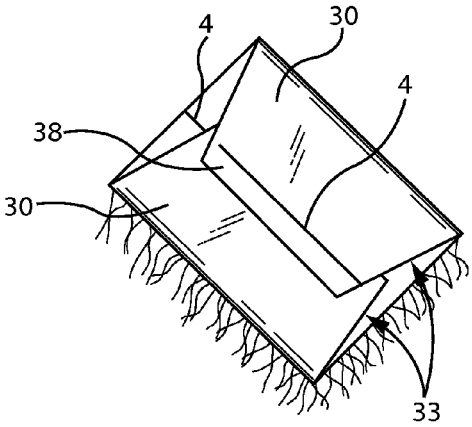
FIG. 6F
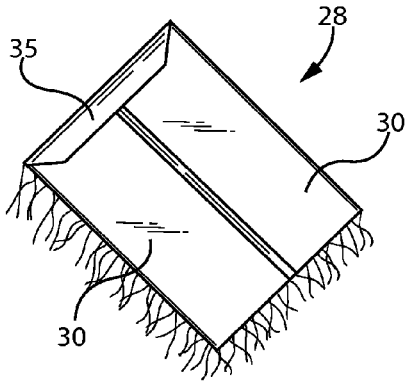
FIG. 6D

CLEANING OR DUSTING PAD WITH ATTACHMENT MEMBER HOLDER

1. CROSS REFERENCE TO RELATED APPLICATIONS

This application is a divisional application of U.S. patent application Ser. No. 12/449,410 filed Aug. 6, 2009, now U.S. Pat. No. 8,528,151, and entitled Cleaning or Dusting Pad with Attachment Member Holder, which claims a benefit of priority under 35 U.S.C. §119 based on U.S. Provisional Patent Application Ser. No. 60/888,481, filed Feb. 6, 2007, the entire contents of which are hereby expressly incorporated by reference into the present application.

BACKGROUND OF THE INVENTION

1. Field of the Invention

The present invention relates to the field of cleaning devices such as handheld dusters and dust mops. More particularly, the present invention relates to an improved cleaning or dusting pad having simple and low cost means for producing a cleaning pad.

2. Discussion of the Related Art

For centuries, handheld feather dusters, dust rags and other cleaning implements have been used as cleaning tools for the removal of dust adhering to furniture such as dressers and coffee tables, electrical appliances such as computers, lights, interior walls, lintels, and the like. Thus, it is generally well known to remove dust or dirt from floors, furniture, and other household surfaces by rubbing a dust rag, cloth, or other cleaning implement against the surface such that the dust or dirt adheres to the cleaning implement.

Throughout the last half-century, new cleaning implements have been developed to assist the individual in dusting and similar cleaning chores. While handheld dusters and other cleaning implements are generally well known in the art, numerous drawbacks exist with the current commercially available designs.

Many of the existing disposable dusting or cleaning cloths start with a base sheet having a fiber bundle fused to one side and a separate holding or retaining sheet fused to the other side of the base sheet. The fiber bundle provides a material for picking up and retaining dust and other particulates. The holding sheet provides a space for inserting and retaining the forks of commercially available cleaning implement handles, such as that found in the Pledge® Duster Plus® cleaning kit.

However, using a separate sheet as a retaining means often requires additional steps and material in the cleaning pad manufacturing process. These extra steps and material increase manufacturing costs by requiring more manufacturing time, more material used, and additional quality control for the additional points of failure created. A dusting cloth or cleaning pad having an attachment member retention means integral to a single or multiple base sheets, or without the need for a separate holding sheet, would eliminate the need for additional material and associated costs.

Therefore, while some improvements to dusting cloth retaining means are disclosed in the art, there remains a need for improved cleaning pads that minimize manufacturing costs by requiring less time and material to produce.

SUMMARY OF THE INVENTION

Consistent with the foregoing, and in accordance with the invention as embodied and broadly described herein, preferred embodiments of a cleaning article or cleaning pad are disclosed in suitable detail to enable one of ordinary skill in the art to make and use the invention.

In a first embodiment, a cleaning pad having a brush portion includes a fusible sheet having an outer edge which, in one example, may have very small perforations and a fiber bundle layer including fusible fibers. The fiber bundle layer is fusion-bonded to the fusible sheet to provide a brush portion. A plurality of elongate slit openings is made in the fusible sheet and defines retaining bands into which a holder is to be inserted.

In yet another embodiment, a cleaning pad includes a soft and fusible base sheet, including a solid uncut outer edge and one or more fiber bundle layers including fusible filaments. The two side edges of the fusible base sheet are overlapped and joined together to form a retaining cavity into which a holder is to be inserted. In yet another embodiment, the fusible base sheet is folded back onto itself and bonded to create two retaining cavities. In yet another embodiment, a tube is bonded to itself to make two retaining cavities. In still another embodiment, bands of material, e.g., elastic, are fused to the base sheet to create a plurality of retaining bands.

In another aspect of the invention, a cleaning pad comprises two base sheets that are secured to be generally parallel to one another and two fiber bundle layers, wherein for each base sheet, a fiber bundle layer is fusion-bonded to the base sheet along a central bonding line and at spot-bonding regions. The cleaning pad further comprises a retaining cavity for receiving a holder formed between the two base sheets, wherein the base sheets are positioned so that the fiber bundle layers face outwardly.

In still another aspect of the invention, a method of manufacture may be used to produce a cleaning pad comprising the steps of feeding a first non-woven sheet through a line presser, passing the non-woven sheet through a heat cutter; joining a first layer of tow fiber to the first non-woven sheet at a spot and line heat sealer, passing the first non-woven sheet and the first layer of tow fiber through a heat cutter; and cutting the first non-woven sheet and the first tow fiber to form an individual cleaning pad.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIG. 6C is a perspective view of an alternative configuration of a partially formed attachment member holder for use with the cleaning pad of FIG. 5A;

FIG. 6D is a perspective view of the cleaning pad of FIG. 6C;

FIG. 6E is a perspective view of an alternative configuration of an attachment member holder for use with the cleaning pad of FIG. 5A;

FIG. 6F is a perspective view of an alternative configuration of an attachment member holder for use with the cleaning pad of FIG. 5A;

Figure 1:
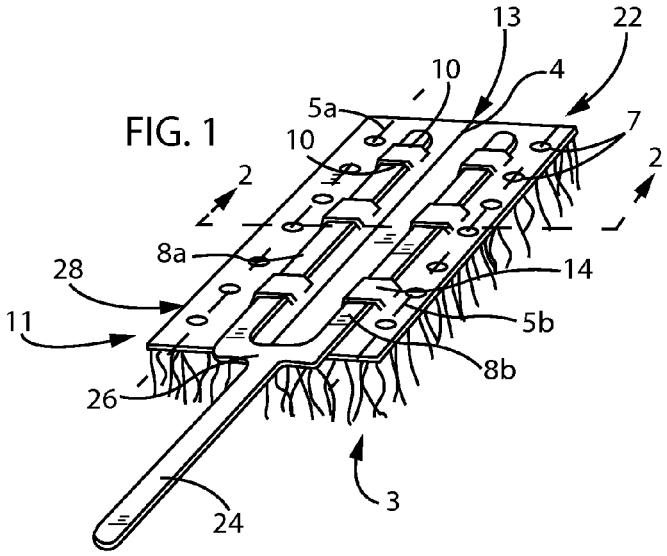
FIG. 1 is a perspective view of a handheld duster incorporating a cleaning pad with an integral cleaning tool attachment member holder constructed in accordance with a first preferred embodiment of the present invention.

In describing the preferred embodiments of the invention, which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words "connected", "joined", or "attached" and terms similar thereto are often used. These words are not limited to any particular manner of connection, joining, or attachment means and methods but include other manners where such connection, joining, and attachment are recognized as being equivalent by those skilled in the art. Furthermore, the words "bond", "bonds", and "bonding" are often used. The word "bond" and variations thereof are intended to be defined as all manners of connection, joining, and attachment including specific methods such as ultrasonic welding, heat-sealing, hook and loop fasteners, e.g., Velcro®, heat-activated adhesives, pressure-sensitive adhesives, sewing and the like.

DESCRIPTION OF PREFERRED EMBODIMENTS

The present invention and the various features and advantageous details thereof are explained more fully with reference to the non-limiting embodiments described in detail in the following description.

1. System Overview

In a basic form, the inventive cleaning pad or dusting cloth is comprised of two layers, i.e., a single fiber bundle bonded to a base sheet layer. The base sheet layer is comprised of a base sheet preferably including a uniform outer edge, such as a solid, non-perforated outer edge. The base sheet layer preferably further comprises an integrally formed cleaning tool attachment member holder formed through a number of preferred inventive methods. The fiber bundle layer is comprised of a number of nonwoven fibers bonded to the nonwoven sheet via a central bonding line and additional spot-bonding regions. The various novel arrangements for the inventive base sheets and fiber bundles eliminate the need for a separate retaining or holding sheet to adhere the dusting cloth to a cleaning tool attachment member, thereby resulting in a simpler and quicker, and therefore less expensive, process for producing the cleaning pad.

2. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

a. Dusting/Cleaning Tool Components

Turning initially to FIGS. 1-3D, a handheld dusting tool 22 generally comprised of a holder, handle portion or handle 24 having a cleaning pad support member, cleaning article support or dusting cloth support 26 attached to a cleaning pad, cleaning media or dusting cloth 28 is illustrated according to a first preferred embodiment of the present invention. The handle 24 and cleaning pad support member 26 can be selected from a number of readily available duster handles configured to comfortably fit within the palm of a hand of a user, such as the handle and support members disclosed in U.S. patent application Ser. No. 11/373,931 now U.S. Pat. No. 7,566,671. The handle 24 may be constructed from a variety of synthetic resins, plastics, or other suitable materials. In the preferred embodiments, handle 24 is constructed from polypropylene while the cleaning pad support member 26 preferably includes a pair of parallel attachment members, prongs, or forks 8*a*, 8*b*. The forks may contain protrusions and/or detents to better secure the pad.

The cleaning pad attachment members 8*a*, 8*b* are configured to engage and retain the cleaning pad 28 on the handle 24. It is recognized that although the first preferred embodiment illustrates a pair of attachment members 8*a*, 8*b*, multiple configurations may be utilized. For example, a single, wider, and different-shaped attachment member could be utilized.

In the preferred embodiments, the cleaning pad 28 is generally comprised of a brush portion 11 comprised of a fiber bundle 3 layered on one surface of a base sheet 2 having fringeless outer edges, though formed with small perforations, and an attachment portion 13, i.e., the means for retaining the cleaning pad 28 to the attachment member 26 of handle 24. The novel attachment portion or cleaning tool attachment member holder 13 eliminates the need for retaining sheets used in prior art cleaning pads and, specifically, dusting cloths.

The fiber bundle 3 is preferably bonded to the base sheet 2 in the lengthwise direction of the fiber bundle 3 along a central bonding line 4 extending continuously along the center of the base sheet 2. In addition, selected portions of the fiber bundle 3 are bonded to the base sheet 2 at various spot-bonding regions 7. Preferably, the spot-bonding regions 7 define discontinuous lines 5*a*, 5*b* that run parallel with the central bonding line 4. Although the spot-bonding regions 7 are illustrated in a linear arrangement, they could be randomly orientated along the base sheet 2. In addition, the fiber bundle 3 could be bonded to the base sheet 2 only with spot-bonding regions 7 and without a central bonding line 4.

The fiber bundle 3 may include fibers preferably constructed from a polymer or plastic, e.g., polypropylene (PP), polyethylene (PE), or polyethylene terephthalate (PET) fibers in a variety of alternative percentages by weight. Such cleaning or dusting pads are described in PCT/JP2004/10507. In a preferred embodiment, the fiber bundle 3 is comprised of bi-component: fibers having a PET core and a PE sheath. In an alternative embodiment, the fiber bundle 3 is comprised of bi-component fibers having a PP core and a PE sheath.

The base sheet 2 is preferably constructed from a nonwoven sheet of PE and PET or other equivalent as is well known in the art. Alternatively, the base sheet 2 may include elastic fibers or be constructed from an elastic material such as that described in greater detail below.

Figure 2:
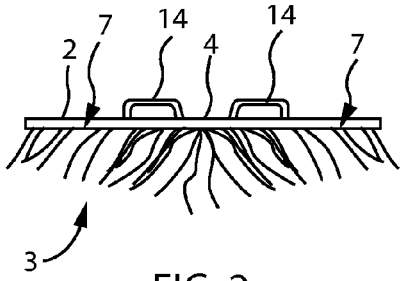
FIG. 2 is a sectional plan view taken generally along the lines 2-2 in FIG. 1.

The cross sectional views illustrated in FIG. 2 best illustrate the bonding regions of fiber bundle 3. The fibers of the fiber bundle 3 generally extend freely between the central bonding line 4 and the edges 12*a*, 12*b* of the base sheet 2. However, portions of the fiber bundle 3 are intermittently bonded to the base sheet 2 at various spot-bonding regions 7.

b. Cleaing Pad with Attachment Portion Formed by Holes or Elongate Slit Openings Still referring to FIGS. 1-3D, a preferred embodiment of a cleaning pad 28 is constructed without a retaining sheet. The cleaning pad 28 instead has an attachment portion 13 integrally formed within the base sheet 2 by holes, e.g., a plurality of elongate slit openings 10, as illustrated.

Either before or after the fiber bundle 3 is bonded to the base sheet 2 as described above, a plurality of slits 10 is made in the base sheet 2. The slits 10 are centered about the central bonding line 4 such that a slit 10 on one side of the central bonding line 4 has a mirrored slit 10 on the other side of the central bonding line 4. Each slit 10 also has a paired slit 10 whereby a retaining band 14 is formed between the two slits.

The slits 10 allow each attachment member 8*a*, 8*b* to be inserted through the retaining bands 14. The attachment members 8*a*, 8*b* are inserted through a number of bands 14 and held in an engaging relationship with the cleaning pad 28.

Elastic fibers (not shown) may be added to the nonwoven base sheet 2 during the formation of the base sheet 2 to provide improved stretch and recovery characteristics. The elastic fibers act to securely fasten the cleaning pad 28 to the attachment members 8*a*, 8*b* and further prevent the retaining bands 14 from being stretched out in use. A tight fit defined by retaining bands 14 serves to properly secure and orientate the cleaning pad 28 with respect to the attachment members 8*a*, 8*b* such that the cleaning pad 28 is substantially coplanar with the orientation of the attachment members 8*a*, 8*b*.

In one arrangement of the first preferred embodiment shown in FIG. 1, a total of twelve slits 10 creates six distinct retaining bands 14. Attachment members 8*a*, 8*b* are retained by three bands 14 each.

As further shown in FIGS. 3A-3D, the cleaning pad 28 of this embodiment can be configured from any number of retaining band/slit configurations, bonding patterns, bonding shapes, and bonding means (e.g., heat, ultrasonic, pressure, sewn, etc.). For example, in the alternative configuration shown in FIG. 3A, a total of six slits 10 is made in the base sheet 2 centered about and extending through the central bonding line 4. The central bonding line 4 divides each flap 15 formed by paired slits, e.g., 10*a*, 10*b*, into two distinct retaining hands, e.g., 14*a*, 14*b*, to form a total of six retaining hands 14. The attachment members 8*a*, 8*b* are inserted through and retained by three retaining bands 14 each. As shown, two generally linear arrangements, i.e., lines 5*a*, 5*b*, of spot-bonding regions 7 extend along the length of the base sheet 2 parallel to the central bonding line 4. The spot-bonding regions 7 are generally located between the retaining bands 14 and the side edges 12*a*, 12*b* of the base sheet 2.

Figure 3A:
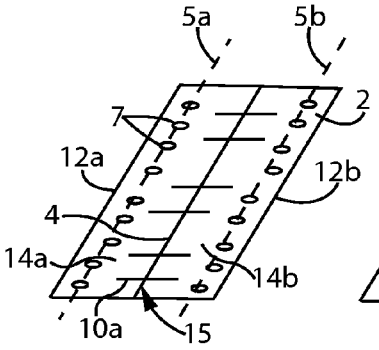
FIG. 3A is a perspective view of an alternate configuration of a cleaning pad attachment member holder for use with the duster of FIG. 1.
Figure 3B:
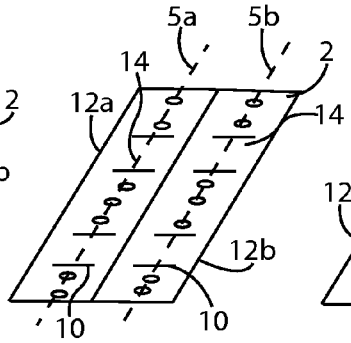
FIG. 3B is a perspective view of another embodiment of a cleaning pad attachment member holder for use with the duster of FIG. 1.

In the alternative configuration of the cleaning pad 28 shown in FIG. 3B, four retaining bands 14 are formed from eight slits 10 made in the base sheet 2. The slits 10 do not intersect the central bonding line 4. Two lines 5*a*, 5*b*, of spot-bonding regions 7 extend parallel to the central bonding line 4 approximately co-linearly with the paths of the inserted attachment members 8*a*, 8*b*.

Figure 3C:
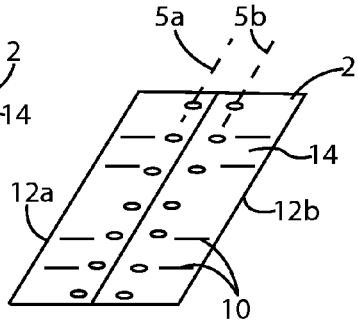
FIG. 3C is a perspective view of another embodiment of a cleaning pad attachment member holder for use with the duster of FIG. 1.

In the alternative configuration shown in FIG. 3C, two lines 5*a*, 5*b* of spot-bonding regions 7 are located between the central bonding line 4 and retaining bands 14 parallel to the bonding line 4. As shown, slits 10 may be spaced apart from each other to create wider retaining bands 14, if desired.

Figure 3D:
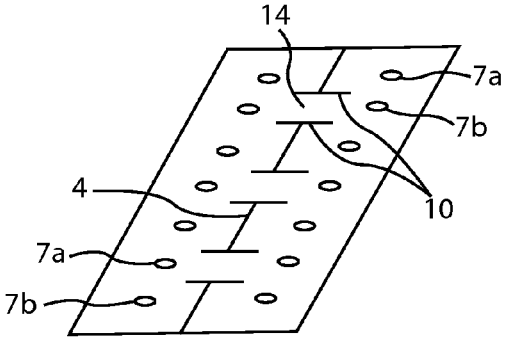
FIG. 3D is a perspective view of another embodiment of a cleaning pad attachment member holder for use with the duster of FIG. 1.

In the alternative configuration of the cleaning pad 28 shown in FIG. 3D, three retaining bands 14 are formed from six slits 10 made in the base sheet 2. This cleaning pad 28 is designed to be used with a single attachment member. The central bonding region 4 is a discontinuous line bond such that portions of the fiber bundle 3 are not fused to the base sheet 2 in the retaining band 14 region. The portions of the fiber bundle 3 located adjacent to the bands 14 are instead held in place by larger bond welds 7*a*, as shown. The diameter of each bond welds 7*a* is equal to the width of the corresponding retaining band 14 to ensure full bonding of the fiber bundle 3 over the length of the base sheet 2. Bond welds 7*b* adjacent to the discontinuous central bonding line 4 do not need to be as wide as the other bond welds 7*a*.

Figure 4A:
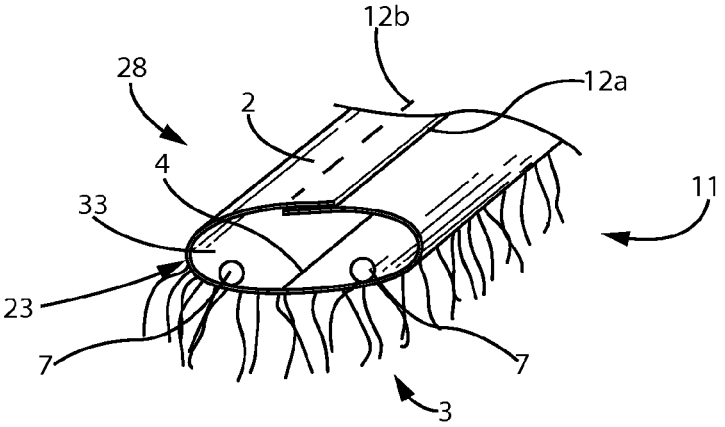
FIG. 4A is a fragmentary perspective view of a cleaning pad having an attachment member holder constructed in accordance with a second preferred embodiment of the present invention.
Figure 4B:
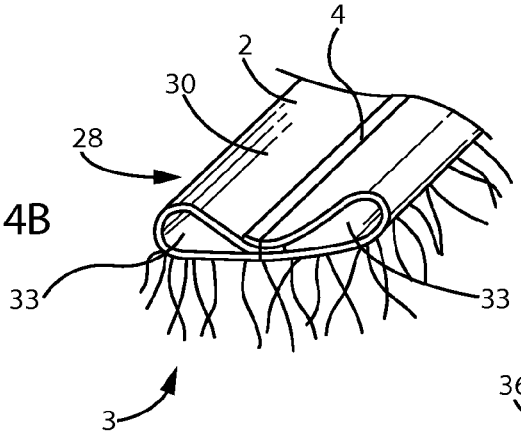
FIG. 4B is a fragmentary perspective view of an alternative configuration of the cleaning pad of FIG. 4A having an alternative attachment member holder.

The discontinuous central bond line 4 can be formed through a bond, e.g., ultrasonic bonding or heat sealing, applied either in an online process on the production machine or in an offline process after the machine. The manufacturing process for the cleaning pad 28 of FIG. 3D involves first bonding a base sheet 2 having pre-formed slits 10 to the fiber bundle 3 via bond welds 7*a*, 7*b*. If done offline, a handheld bonding tool, e.g., an ultrasonic bonding tool or a heat sealing tool, is inserted through the retaining bands 14 and bonds the base sheet 2 and fiber bundle 3 together resulting in the discontinuous central line bond 4. For the cleaning pads 28 shown in FIGS. 1-3D, the spot-bonding regions 7 may be circles, ellipses, ovals, dashes, and the like. The spot-bonding regions 7 could also be formed to create various patterns, designs, trademarks, and so on. Non-uniform shapes or arrangements are also contemplated.

c. Cleaning Pad with Attachment Portion Formed by Bonding a Base Sheet to Itself FIGS. 4A-4D illustrate a second preferred embodiment of a cleaning pad 28 constructed without a retaining sheet. As shown in FIGS. 4A-4B, an attachment portion 13 is generally formed by overlapping one edge 12*a* of a base sheet 2 over the other edge 12*b* and bonding an overlapped portion. The overlapping edges 12*a*, 12*b* can be bonded to each other only or bonded to the base sheet 2.

In the configuration illustrated in FIG. 4A, a fiber bundle 3 is bonded to a base sheet 2 in the configuration disclosed with the first preferred embodiment, i.e., with a central bonding line 4 and spot-bonding regions 7. In this embodiment, the base sheet 2 is substantially wider than the fiber bundle 3 such that a pair of flaps 30 having no associated fiber bundle 3 is formed. The central bonding line 4 may be formed with a bonding tool, e.g., an ultrasonic bonding tool or heat sealing tool, disclosed for the embodiment shown in FIG. 3D.

One flap 30 of the base sheet 2 is folded over the other flap 30 such that the edge 12*a* of the first flap 30 overlaps the edge 12*b* of the second flap 30. The edges 12*a*, 12*b* overlap along the entire length of the cleaning pad 28. The overlapped edges 12*a*, 12*b* are connected or bonded to each other in any number of ways including, but not limited to Velcro®, glue, heat-fusion, pressure-sensitive adhesives, etc., to define an insertion opening 23. A generally tubular attachment portion 13 consisting of a cavity 33 for inserting and retaining the attachment members 8*a*, 8*b* is also formed by the bonded flaps 30, 30 of the overlapped base sheet 2.

In use, attachment members 8*a*, 8*b* are placed through the insertion opening 23 of the cleaning pad 28 and fully inserted into the retaining cavity 33. The attachment members 8*a*, 8*b* are retained in the cavity 33 with a high coefficient of friction to prevent the cleaning pad 28 from separating from the attachment members 8*a*, 8*b* of the cleaning implement handle 24. As with the first preferred embodiment of FIGS. 1-3D, elastic fibers may be added to the base sheet 2 to provide increased flexibility.

In an alternative configuration of the second preferred embodiment illustrated in FIG. 4B, one edge, e.g., 12*b*, of the base sheet 2 is folded over the other edge, e.g., 12*a* as before, but the overlapping edges 12*a*, 12*b*, base sheet 2 and fiber bundle layer 3 are all bonded together. The bonding may be accomplished via the central bonding line 4 used to adhere the fiber bundle 3 to the base sheet 2 or it may be made via a separate bonding step. Spot bonding regions 7 are also used to adhere portions of the fiber bundle 3 to the base sheet 2 at a distance from the central bonding line 4. The bonding of the overlapping edges 12*a*, 12*b* to the base sheet 2 results in the formation of two distinct retaining cavities 33. Attaching the cleaning pad 28 to the attachment members 8*a*, 8*h* is accomplished, by fully inserting the attachment members 8*a*, 8*b* into the retaining cavities 33 where the members 8*a*, 8*b* are held firmly in place.

Figure 4D:
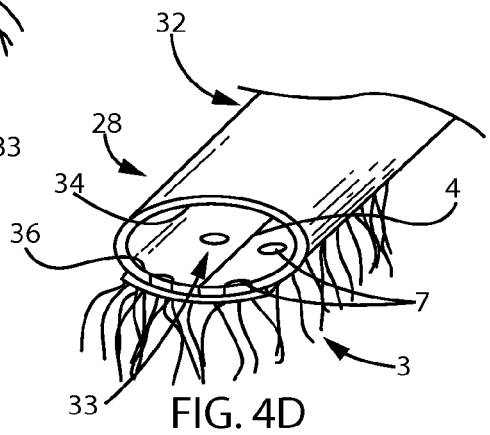
FIG. 4D is a fragmentary perspective view of another embodiment of the cleaning pad of FIG. 4A having an alternative attachment member holder.
Figure 4C:
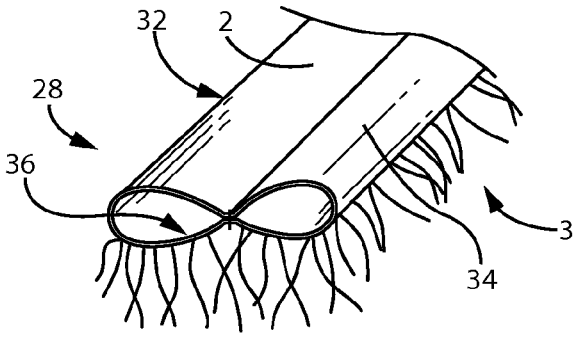
FIG. 4C is a fragmentary perspective view of another embodiment of the cleaning pad of FIG. 4A having an alternative attachment member holder.

In the alternative configuration illustrated in FIG. 4C, the base sheet 2 is formed into a cylindrical tube 32 through a butt closure via a weld or other bonding process. Alternatively, the tube 32 is received as a cylindrical tubular fabric with no bonding required. The fiber bundle 3 is bonded to the bottom 36 of the tube or tubular base sheet 2 via a bonding line 4 and spot bonding regions 7 as previously disclosed. The top 34 of the tube 32 may be bonded to the bottom 36 of the tube 32 dividing the tube 32 into two distinct retaining cavities 33. Attachment members 8*a*, 8*b* are inserted into and held within the retaining cavities 33 as previously disclosed. Alternatively, and as shown in FIG. 4D, the top 34 of the tube 32 may remain unbonded to the bottom 36 to maintain a single larger retaining cavity 33 such as shown in FIG. 4A.

Alternatively, Velcro® strips (not shown) could be placed near the edges 12*a*, 12*b* of the base sheet 2 flaps 30 and secured to corresponding strips located near the bonding line 4. This would also create the embodiment shown in FIG. 4C as the edges 12*a*, 12*b* would not overlap and two retaining cavities 33 would be formed by the closure.

d. Cleaning Pad with Attachment Portion Formed by Folding Over Base Sheet

FIGS. 5A-6F illustrate a third preferred embodiment of a cleaning pad 28 constructed without a retaining sheet. The cleaning pad 28, in the configuration illustrated in FIGS. 5A-5C, instead has an attachment portion 13 formed by folding over the base sheet 2 flaps 30 and bonding them to the base sheet 2.

Figure 5A:
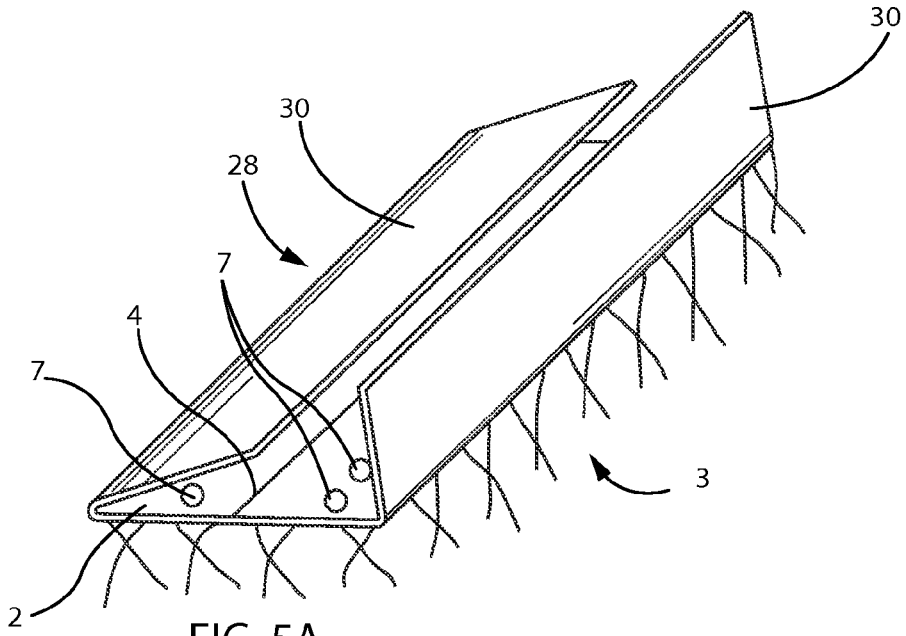
FIG. 5A is a perspective view of a cleaning pad showing a partially formed attachment member holder constructed in accordance with a third preferred embodiment of the present invention.
Figure 5B:
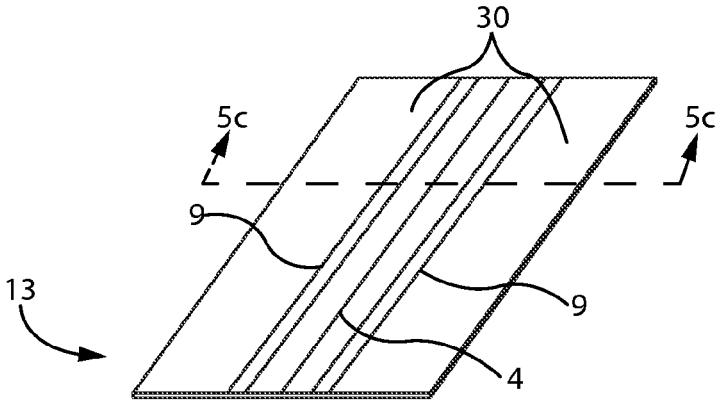
FIG. 5B is a perspective view of the cleaning pad of FIG. 5A.
Figure 5C:
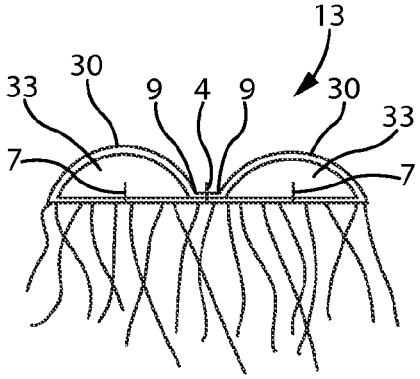
FIG. 5C is a sectional plan view taken generally along the lines 5C-5C in FIG. 5B.

The cleaning pad 28 has a fiber bundle layer 3 bonded to a base sheet 2 via a central line bond 4 and spot bonding regions 7 as previously disclosed. The base sheet 2 extends beyond the fiber bundle layer 3 to produce flaps 30. The flaps 30 are folded back onto the base sheet 2 and bonded via parallel flap bonds 9. The bonded flaps 30 define two attachment member retaining cavities 33. As shown in FIG. 5C, flap bonds 9 may join the flaps 30 to the base sheet 2 and the fiber bundle 3. In this sense, the cleaning pad 28 has three main bond lines.

Figure 6A:
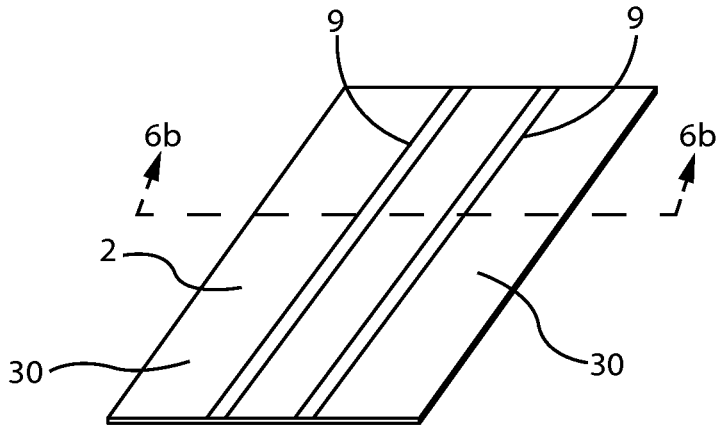
FIG. 6A is a perspective view of an alternative configuration of an attachment member holder for use with the cleaning pad of FIG. 5A.
Figure 6B:
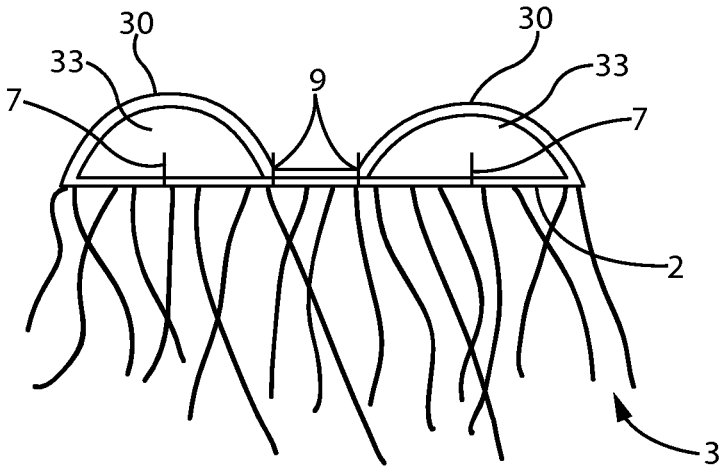
FIG. 6B is a sectional plan view taken generally along the lines 6B-6B in FIG. 6A.

In an alternative configuration shown in FIGS. 6A-6B, a central bonding line is not used. Instead, each parallel flap bond 9 bonds a flap 30 to the base sheet 2, and to a fiber bundle 3. The bonded flaps 30 define retaining cavities 33. Spot bonding regions 7 may also be used to attach portions of the fiber bundle 3 to the base sheet 2. In this sense, the cleaning pad 28 has only two main bond lines.

In both cleaning pad 28 configurations, attachment members 8*a*, 8*b* are inserted into the retaining cavities 33 and retained via a friction fit to create the handheld dusting tool 22. An extra flap (35 of FIG. 6C-6E) may be used at one end of the cleaning pad 28 to prevent the attachment members 8*a*, 8*b* from extending through the retaining cavities 33. Alternatively, one end of the folded base sheet 2 may be folded over in a c-fold or w-fold to create a pocket or envelope such that the attachment members 8*a*, 8*b* do not extend through the retaining cavities 33 and possibly come into contact with a surface to be cleaned. Alternatively, one end of the flaps 30 could be bonded to the base sheet 2 to form the pocket.

In yet another alternative configurations shown in FIG. 6E, one flap 30 could be formed longer than the other flap 30 such that when the flaps 30 are folded over, the longer flap 30 would overlap the shorter flap 30. The flaps 30 could be bonded to each other in the overlapping portion 38 but not bonded to the base sheet 2, thereby forming one retaining cavity 33. Alternatively, as shown in FIG. 6F, the flaps 30 could be bonded together with a bond 4 that also extends to and possibly through the base sheet 2, thereby forming two retaining cavities 33.

e. Cleaning Pad with Attachment Portion Formed by Adding, Bands

Figure 7A:
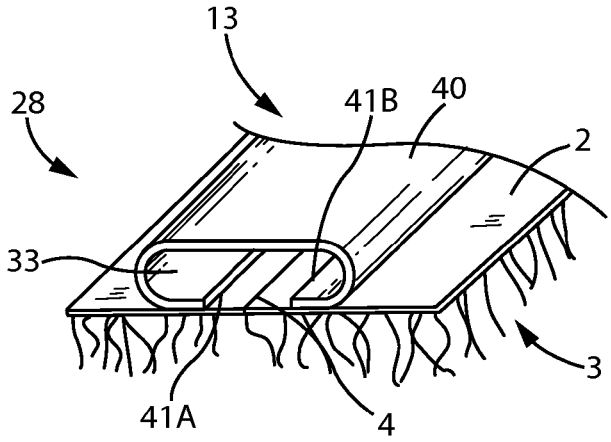
FIG. 7A is a fragmentary perspective view of a cleaning pad having an attachment member holder constructed in accordance with a fourth preferred embodiment of the present invention.
Figure 7B:
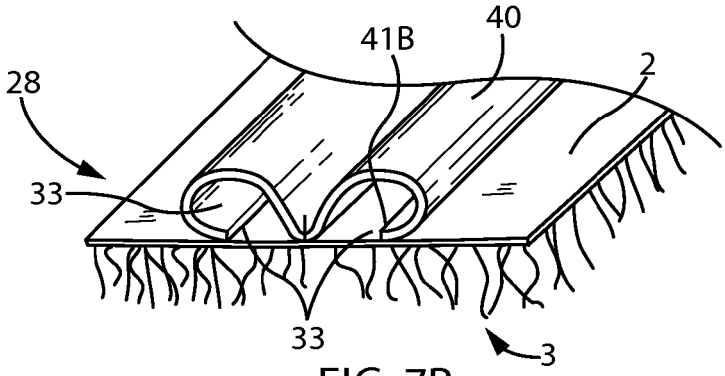
FIG. 7B is a fragmentary perspective view of an alternative configuration of an attachment member holder for use with the cleaning pad of FIG. 7A.
Figure 7C:
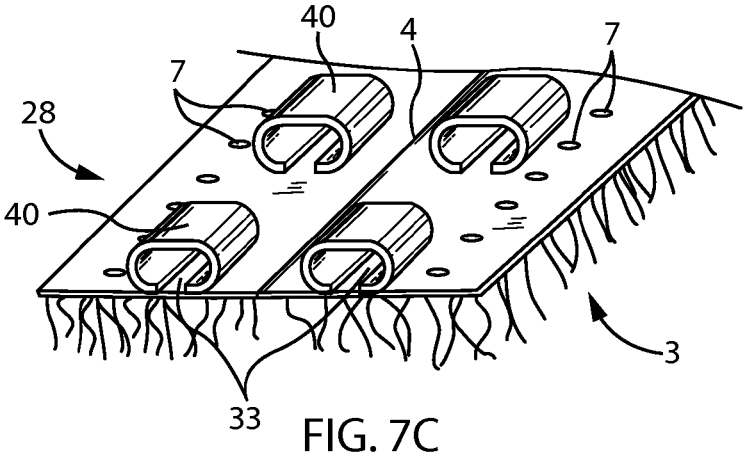
FIG. 7C is a fragmentary perspective view of an alternative configuration of an attachment member holder for use with the cleaning pad of FIG. 7A.

FIGS. 7A-7C illustrate a fourth preferred embodiment of a cleaning pad 28 constructed without a retaining sheet. Instead, an attachment portion 13 is formed by the addition of a single or multiple bands 40 bonded to the base sheet 2. The bands 40 can be made from an elastic material but are not so limited.

The cleaning pad 28 is formed with a fiber bundle 3 bonded to a base sheet 2 via central line bond 4 and spot bonding regions 7. In the configuration illustrated in FIG. 7A, a band 40 is bonded at each end 41*a*, 41*b* to the base sheet 2 to define a retaining cavity 33. In the configuration shown in FIG. 7B, the central bonding line 4 bonds the fiber bundle 3, base sheet 2 and band 40 together to define two distinct retaining cavities 33. In the configuration shown in FIG. 7C, a plurality of bands 40 are used to create a plurality of retaining cavities 33. For the cleaning pads 28 shown in FIGS. 7A-7C, attachment members 8*a*, 8*b* are inserted into the cavities 33 and secured via, a friction fit. The bands 40 may take a variety of bonding, size and shape configurations so long as they define retaining cavities 33.

f. Cleaning Pad with Attachment Portion Formed Between Two Cleaning Pads

Figure 8A:
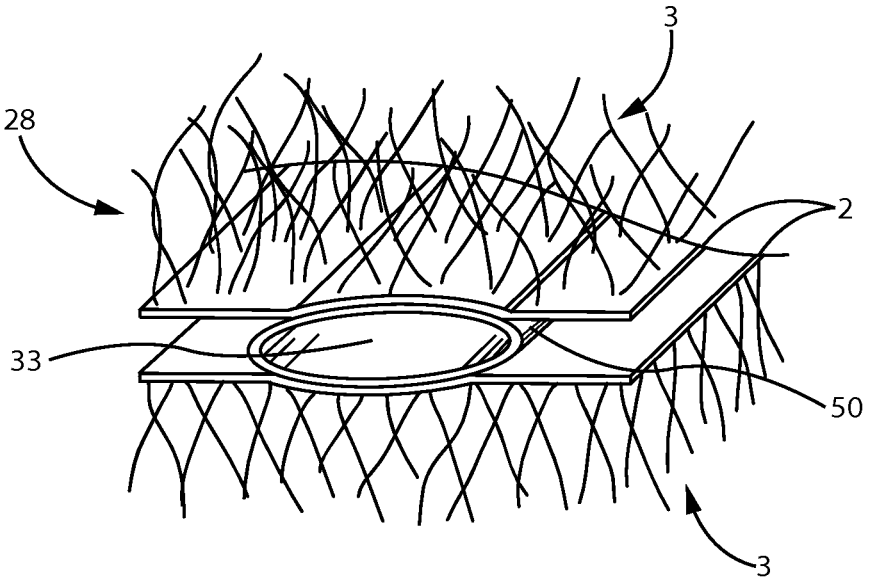
FIG. 8A is a fragmentary perspective view of a cleaning pad having an attachment member holder constructed in accordance with a fifth preferred embodiment of the present invention.
Figure 8B:
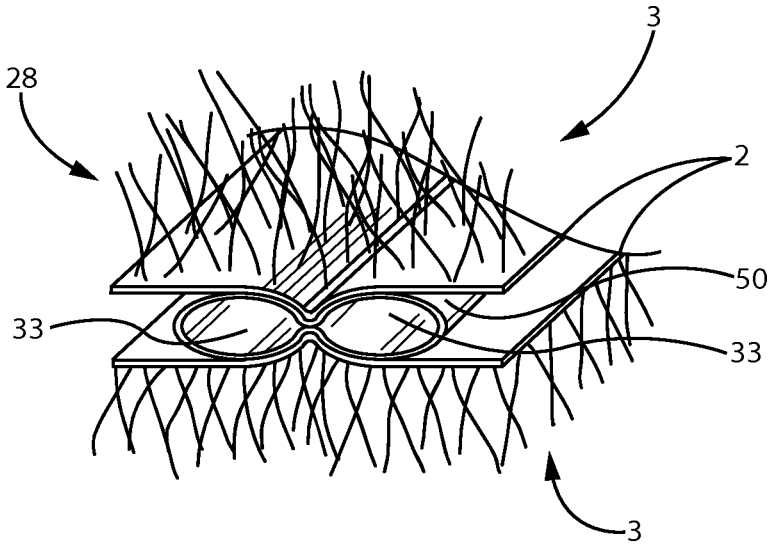
FIG. 8B is a fragmentary perspective view of the cleaning pad of FIG. 8A having an alternative configuration of an attachment member holder.

FIG. 8A illustrates a fifth preferred embodiment of a cleaning pad 28 constructed without a retaining sheet. Instead, an attachment portion 33 is formed by a generally tubular-shaped material piece attached to two base sheets 2. A first base sheet 2 and fiber bundle 3 is bonded to one side of the tubular material piece 50. A second base sheet 2 and fiber bundle 3 is bonded to another side of the tubular material piece 50 to form a two sided cleaning pad 28. Attachment members 8*a*, 8*b* are inserted into a retaining cavity 33 and retained via a friction fit. Alternatively, elastic bands (not shown) may be used to connect the cleaning pads 28 while creating a retaining cavity 33. Alternatively, the tube 50 may be bonded in the middle, such as the embodiment shown in FIG. 8B to create two separate retaining cavities 33.

Figure 9:
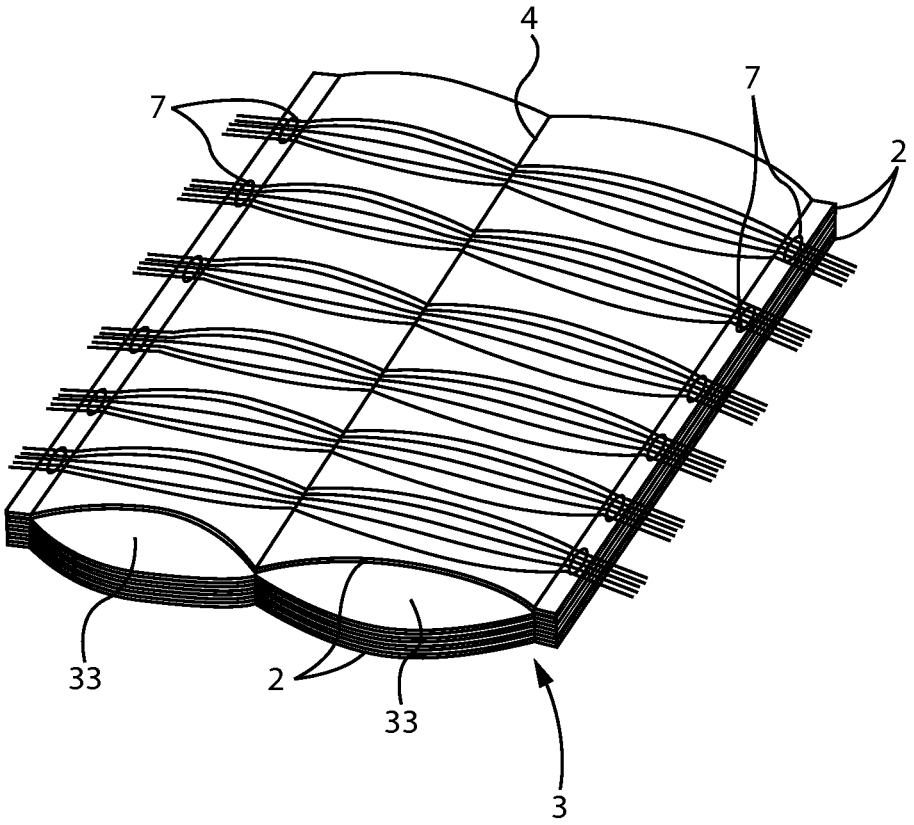
FIG. 9 is a perspective view of another embodiment of the cleaning pad of the present invention.
Figure 10A:
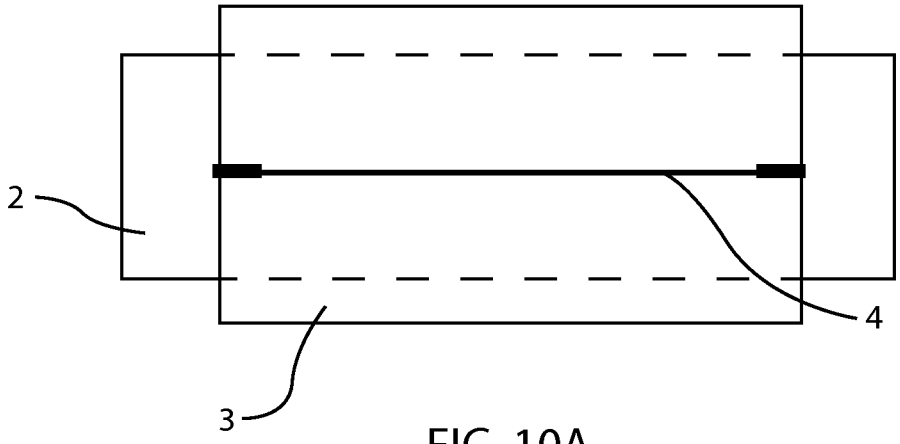
FIG. 10A is a top view showing the fiber bundle layers and the base sheets of the embodiment of FIG. 9.
Figure 10B:
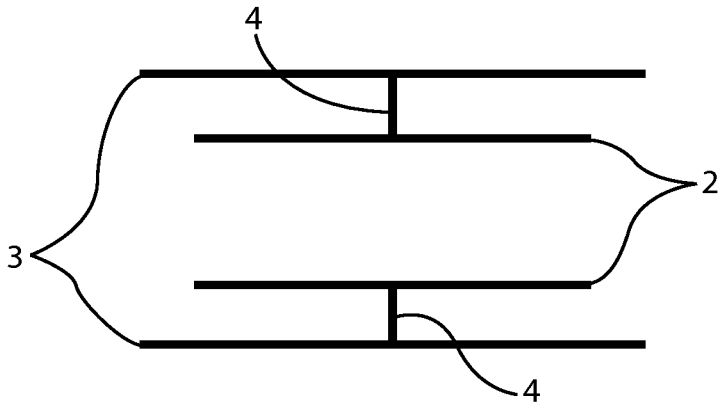
FIG. 10B is an end view of the configuration shown in FIG. 10A.

Another alternative embodiment, as shown in FIG. 9, features two base sheets 2,2 and two fiber bundle layers 3,3 wherein each base sheet 2 has a fiber bundle 3 attached to it, e.g., by fusion-bonding, on one side. The preferred bonding pattern for attaching the fiber bundle layer 3 to the base sheet 2 includes a central bonding line 4 positioned generally near the middle of the base sheet 2, as shown in FIGS. 10A and B. The central bonding line 4 may be a solid line, or it may be a discontinuous line, i.e., it may be formed by spot bonds positioned generally along a central line.

Figure 10C:
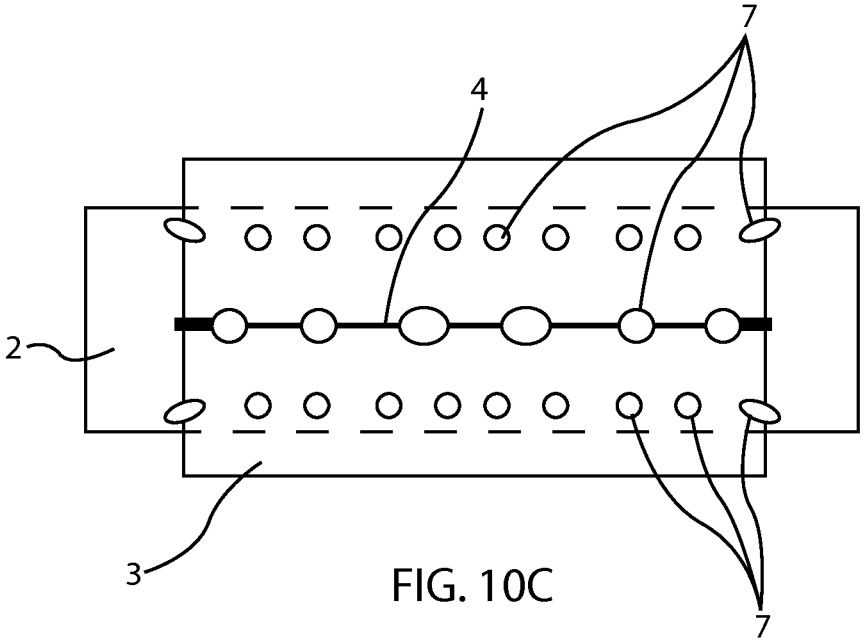
FIG. 10C is a top view showing the preferred spot bonding pattern for the embodiment of FIG. 9.

Additionally, the fiber bundle layer 3 may be attached using a plurality of spot bonding regions 7, as shown in FIGS. 10C and D. Preferably, the spot bonding regions 7 are aligned along one or more lines that are generally parallel to the central bonding line 4. See FIG. 10C. However, any variation of bonding patterns may be used as desired. In this configuration, only some of the fibers of the fiber bundle layer 3 are bound by the spot bonding regions 7.

Figure 10D:
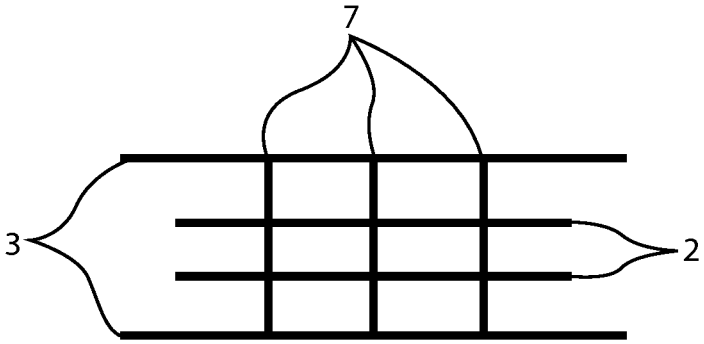
FIG. 10D is an end view of the configuration shown in FIG. 10C.
Figure 10E:
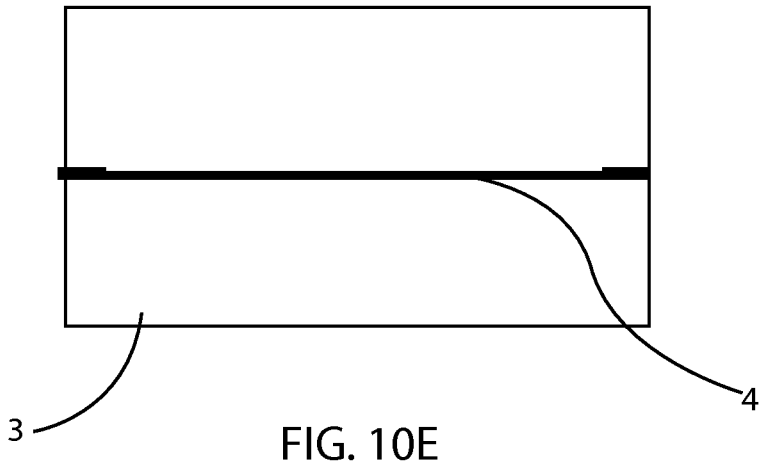
FIG. 10E is a top view of a fiber bundle layer having a central bonding line.
Figure 10F:
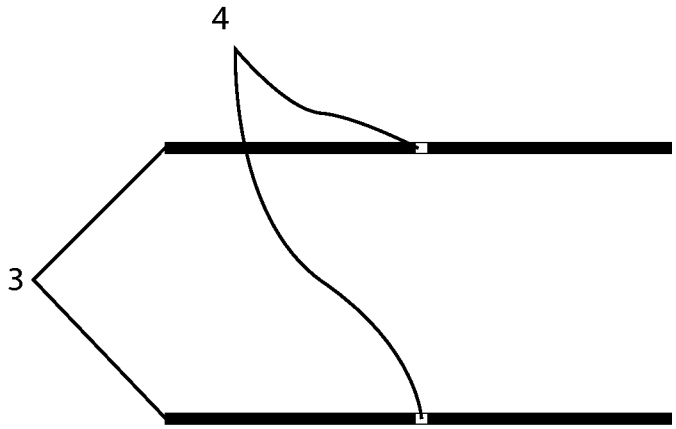
FIG. 10F is an end view of two fiber bundle layers having central bonding lines.

The base sheets 2, 2 are configured to oppose each other such that, for each base sheet 2, the side with the fiber bundle layer 3 faces outwardly. The base sheets 2, 2 are attached to one another, e.g., by fusion bonding at spot bonding regions 7, to form a retaining cavity 33 between the base sheets 2, 2. Moreover, the same fusion-bonds may extend through the fiber bundle layers 3, 3 and the base sheets 2, e.g., the spot bonding regions 7 bond the fiber bundle layers 3, 3 and base sheets 2, 2 to one another. See FIG. 10D. Similarly, the central bonding line 4 may extend through the fiber bundle layers 3, 3 and base sheets 2, 2. In configurations wherein the central bonding line 4 does not attach the base sheets 2, 2 to one another, spot bonding regions 7 may be aligned along the central bonding line 4 to attach the base sheets 2, 2 to another and to divide the retaining cavity 33 into two regions, e.g., to receive a holder having two prongs.

The spot bonding regions 7 may form the retaining cavity 33 between the base sheets 2, 2. In the preferred configuration, spot bonding regions 7 are positioned along the central bonding line 4 and along a plurality of lines that are generally parallel to the central bonding line 4. See FIG. 10C. The lines are preferably located near a respective edge of the base sheet 2. In this configuration, there are two retaining cavities 33 for receiving a holder, e.g., a holder having two prongs. The retaining cavities 33 are preferably open on both ends, thus they are capable of receiving a holder from either end. This may be beneficial because it enables a user to reposition the cleaning pad 28 on the holder if one end of the cleaning pad 28, e.g., the end originally distal to the holder, becomes dirty.

In this embodiment, it is preferred that the fibers of the fiber bundle layers 3, 3 extend beyond the edges of the base sheet 2. Thus, when the base sheets 2, 2 are joined together, the fiber bundle layers 3, 3 form a 360° cleaning surface about the axis along which the holder is inserted into the cleaning pad. Again, this may be achieved by using spot bonds 7 near the edges of the base sheet 2, which may help to maintain the positioning of the fiber bundle layer 3 on the sheet 2 while allowing the ends of the fibers to freely extend beyond the edge of the sheet 2.

Figure 10G:
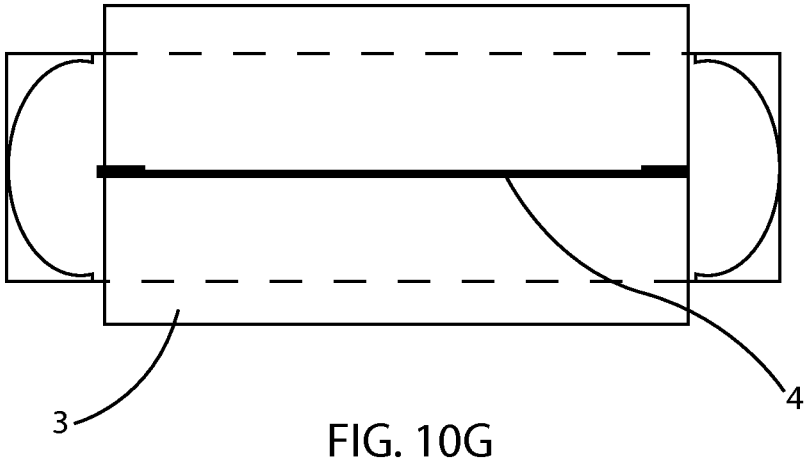
FIG. 10G is a top view of another embodiment of the instant invention having four fiber bundle layers.
Figure 10H:
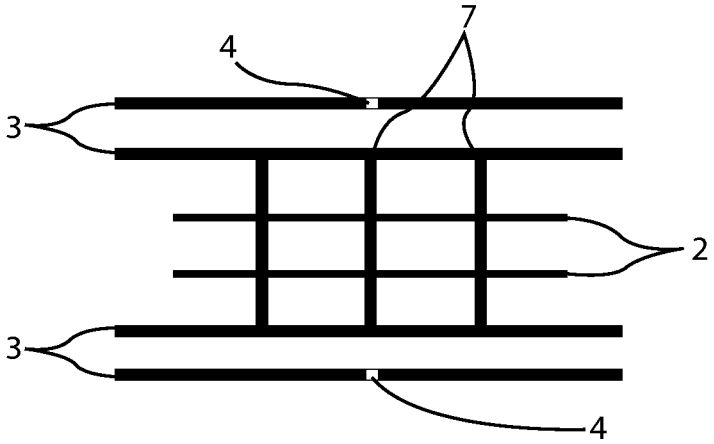
FIG. 10H is an end view of the embodiment of FIG. 10G.

Moreover, this embodiment may include additional fiber bundle layers 3. For example, a third and fourth fiber bundle layer 3 may be attached to the first and second fiber bundle layer 3, respectively, along the central joining line 4. See FIGS. 10G and H. In this configuration, the third and fourth fiber bundle layer 3 may not be attached at the spot bonding regions 7, which may allow for the fibers of the third and fourth fiber bundle layers 3 to extend in a direction generally perpendicular to the base sheets 2, 2. Thus, this configuration may result in a more even distribution of fibers throughout the cleaning surface.

g. Alternative Cleaning Pad Embodiments

It should be recognized that the polymer fibers 3 of the cleaning pad 28 can take a variety of forms to increase various performance characteristics of the handheld duster 22. Standard circular fibers may be used, as is generally known in the art. Alternatively, the individual fibers on the cleaning pad may be lobed in the form of loose tow fibers. The unique lobed configuration creates channels within the individual fibers enabling improved capillary action on each individual fiber and increasing the overall cleaning or dusting surface area thereby increasing the overall efficiency, e.g., of both wet and dry dusting. The higher surface area results in an increase in the proportion of particles adhering in the grooves or channels and results in dust particles being "trapped" within the grooves of the lobed fiber. The lobed fibers generally exhibit improved dust retention, more efficient wet wiping and longer life than standard circular fibers. Furthermore, the lobed fibers can be made stiffer thereby generating a higher wiping pressure in a smaller contact area. It is understood that the inventive lobed fibers could be comprised of, e.g., a multitude of polymers with PP, PE or PET being recognized as the most cost effective alternatives. Alternatively acrylic or biodegradable polymers could be utilized.

In another alternative embodiment, the cleaning pad 28 may include stiffer or strut fibers attached to mass of tow fibers. In this arrangement, the stiffer fibers (usually in the range of about 0.3 mm) carry the majority of the stress applied to the cleaning pad 28. The tow may be linked to the stronger fibers by entanglement at the outer ends of the fiber. The stiffer fibers result in a cleaning pad 28 that is springy resulting in a more desirable feel of applied three for users. The stiffer fibers can further be utilized to clean difficult areas such as crevices, blinds or screens. The stiffer fibers have the further advantage in that they keep the tow volume expanded, thereby increasing dust migration into the tow fibers.

As stated above, the various attachment portions 13 or the base sheet 2 could be constructed of an elastic material. 'Elastic' is a material that is capable of quickly or immediately returning to or towards its initial form or state after deformation. Examples of stretchable materials include natural and synthetic rubbers, laminates, containing at least one elastomeric layer, elastomeric films, spunbond, spunlace, a spunbond laminate (SBL) or other material to those skilled in the art. SBL is a material manufactured and commercially sold by Kimberly Clark Corporation in Neenah, Wis. Some stretchable materials are taught and described in U.S. Pat. Nos. 4,720,415; 5,336,545; 5,366,793; and 5,385.775, SBL (stretch bond laminate) materials are described in U.S. Pat. No. 4,720,415; exemplary NBL (necked bond laminate) materials are described in U.S. Pat. No. 5,336,545; CFSBL (continuous filament stretch bond laminate) materials are described in U.S. Pat. No. 5,385,775; VFL (vertical filament laminate) materials are described in U.S. Pat. App. 2002/011972214; and still other materials such as NSBL (neck stretch bond laminate) and NTL (necked thermal laminate) can also be used.

The cloth could be constructed from a stretch bonded laminate (SBL). Exemplary SBL materials are described in U.S. Pat. No. 4,720,415. In the stretch bonded laminate, the elastic core, or middle layer, is elongated before the two outer nonwoven layers are attached. The attachment can be by an adhere, by heat, by pressure, by a combination of heat and pressure, etc. Another material option for the cloth is a necked bonded laminate (NBL). The NBL material is also a three-layer laminate but the elastic core, or middle layer, is not pre-stretched prior to being attached to the two outer nonwoven layers. The outer layers are necked stretched before the elastic core or middle layer is attached to them. Exemplary NBL materials are described in U.S. Pat. No. 5,336,545. Other examples of elastomeric materials that can be used for the cloth include a continuous filament stretch bonded laminate (CFSBL) described in U.S. Pat. No. 5,385,775, a vertical filament laminate (VFL) described in Patent Publication 2002/0119722 A1 dated Aug. 29, 2002, a necked stretch bonded laminate (NSBL), and a necked thermal laminate (NTL). Combinations of the above materials can also be used.

It should also be noted that the base sheet 2 can be constructed from an elastic film that is capable of being stretched in at least one direction and desirably in both the machine direction and the cross-direction. Alternatively, the base sheet 2 can be formed from an elastic nonwoven that has a machine direction stretch and/or a cross-direction stretch. Various other stretchable and elastic materials can be used which are known to those skilled in the art.

The base sheet 2 can alternatively be formed from two outer layers with a plurality of elastic strands sandwiched therebetween. The elastic strands can be formed from Lycra®. The elastic strands can be aligned approximately parallel to one another or be angled or skewed relative to one another. The elastic strands can also be uniformly or randomly spaced apart from one another. The elastic strands can vary in shape, size, configuration, and/or length. The diameter and/or cross-sectional configuration of the elastic strands, the decitex (weight in grams per 10,000 meters of a strand) of the elastic strands, and the tension imparted into the elastic strands can all be varied to suit one's particular product needs. The elastic strands can have a round, semi-circular, square, rectangular, oval or some other geometrical configuration. The elastic strands can overlap, intersect or crisscross at least one other elastic strand. The various ways of positioning, orienting, and adhering the elastic strands to the two outer layers are well known to those skilled in the art.

In yet another alternative embodiment, the cleaning pad 28 could include absorbent materials in particulate form fixed onto the remaining fibers of the cleaning pad 28. The absorbent materials may take the form of known super absorbent polymers SAP. The SAPs may be for example, acrylic based polymers applied as a coating or turned into fibers directly. Such commercially available SAPs generally include X-linked polyacrylic acids or X-linked starch-acrylic-acid-graft-polymers, the carboxyl groups of which are partially neutralized with sodium hydroxide or caustic potash. The SAPs may be made by such processes as a solvent or solution polymerization method or the inverse suspension or emulsion polymerization method. Such SAPs are disclosed in, for example, U.S. Pat. No. 6,124,391.

The absorbent materials increase the overall absorbency of the fibers, prevent the fibers from packing close together into a fiber mass, and enhance the friction of the fibers. The "string of pearls" arrangement also allows for strategically placed high absorbency regions on the cleaning pad. For example, if it is desirable to have the forward end of the cleaning pad 28 be more absorbent than the remainder of the cleaning pad 28, the forward end could include a higher percentage of the particulate absorbent materials.

The fiber bundle 3 may be formed from shaped fibers, splittable fibers, hollow fibers, coated fibers, or combinations of any of these. Also, combinations of many different polymer materials to get better performance properties can be used. Coatings could include surfactant cleaners, waxes, charge additives, controlled tack adhesives (PSAs), coefficient of friction additives, step-out coatings which are "smart," triggered, and/or interactive.

The cleaning pad 28 could also include fibers that are formed into helices. Such fibers can be formed by drawing fiber bundles over a blade or heating coaxial bicomponent fibers. The resulting helical fibers exhibit a fluffier texture and more attractive appearance while at the same time increasing the volume (while using less fiber) and dust retention of the duster. The helical nature of the fibers is also advantageous in that they allow coarse fibers to feel softer due to the spring effect. Furthermore, the fibers gradual loss of the helical nature, can serve as an indication of the effective life of the cleaning pad.

It should be recognized that none of the aforementioned fiber materials or configurations are exclusive. The cleaning pad could include strategic combinations of the various fibers and other known fibers. In one example, the cleaning pad may be comprised of between 25-100% of the lobed fibers by weight.

The cleaning pad 28 may also include a portion of an unbonded web material, as described in U.S. Pat. No. 5,858,515 to Stokes et al. and U.S. Pat. No. 5,962,112 to Haynes et al. or other material such as described by U.S. Pat. No. 4,720,415 to Vander Wielan et al. or any super absorbent material such as described in U.S. Pat. Nos. 4,995,133 and 5,638,569 both to Newell, U.S. Pat. No. 5,960,508 to Holt et al., and U.S. Pat. No. 6,003,191 to Sherry et al.

In one embodiment, the cleaning pad 28 may comprise a spunbond fiber nonwoven web having a basis weight of approximately 68 grams per square meter. The spunbond fibers may comprise bicomponent fibers having a side-by-side configuration where each component comprises about 50%, by volume, of the fiber. The spunbond fibers will comprise first and second polypropylene components and/or a first component comprising polypropylene and a second component comprising propylene-ethylene copolymer. About 1% or more or less of titanium oxide or dioxide is added to the fiber(s) in order to improve fiber opacity. The spunbond fiber nonwoven web is thermally bonded with a point unbonded pattern. The nonwoven web is bonded using both heat and compacting pressure by feeding the nonwoven web through a nip formed by a pair of counter-rotating bonding rolls; the bonding rolls comprise one flat roll and one engraved roll. The bonded region of the nonwoven web comprises a continuous pattern that corresponds to the pattern imparted to the engraved roll. Further, the bonded region is applied to the web when it passes through the nip. The bonded region will range between approximately about 27% to about 35% of the area of the nonwoven web and forms a repeating, non-random pattern of circular unbonded regions. Absorbency enhancing or superabsorbent materials, including superabsorbent polymers, powders, fibers and the like may be combined with the cleaning pad 28.

Alternatively, the cleaning pad 28 comprises a laminate of an air-laid composite and a spunbond fiber nonwoven web. The nonwoven web may comprise monocomponent spunbond fibers of polypropylene having a basis weight of approximately 14 grams per square meter. The air-laid composite may comprise from about 85% to about 90% kraft pulp fluff and from about 10% Co about 15% bicomponent staple fibers. The bicomponent staple fibers may have a sheath-core configuration; the core component comprising polyethylene terephthalate and the sheath component comprising polyethylene. The air-laid composite has a basis weight between about 200 and about 350 grams per square meter and an absorbency of between about 8 and about 11 grams per gram.

The cleaning pad 28 may also include a portion or side of hydrophilic fibers useful for scrubbing. Additionally, nylon fibers may be used to increase the coefficient of friction when they become wet. Portions of the cleaning pad 28 may be composed of microfibers and ultra-microfibers having a denier per filament (dpf) less than or equal to about 1.0. The term microfiber is generally understood to be used for fibers with denier per filament of less than one micron. They can be produced in four different ways—direct melt spinning, electro-spinning, flash spinning, and bi-component technology.

As described, the cleaning pad 28 can be formed by any material or material-forming process known, including woven and non-woven materials, polymers, gels, extruded materials, laminates, layered materials which are bonded together integrally and thus form a co-material, fused materials, extruded materials, air laying, etc.

The cleaning pad 28 may alternatively be optimized for providing a cleaning fluid to the surface, such as with micro capsules or encapsulated fluids or agents. The enhanced surface of the cleaning pad 28 can have scrubbing or abrasive qualities. The enhanced surface can also be formed by a mechanical stamping, bonding, pressing, compression, extrusion, sprayed, sputtered, laminated or other surface forming or affecting process. The various alternative cleaning solutions discussed above could be microencapsulated into the cleaning pad such that they are selectively released by some additional stimulus. It is understood that various cleaning solutions microencapsulated into the cleaning pad could be activated by water, another chemical in the fluid reservoir or pressure. The solutions could be dry impregnated. Alternatively, the chemical solutions could be encapsulated in pockets or bubbles on or within the cleaning pad 28 or on the cleaning media support 26. The pockets could be designed to burst and release the cleaning solution upon the application of moderate pressure.

It should be understood, that the spot bonding regions 7 can be produced in other configurations, and are not limited to the above noted configuration. For example, the spot bonding regions 7 may define one parallel line between the central bonding line 4 and the edge 12*a* and one parallel line between the central bonding line 4 and the opposed edge 12*b*, so that they define only two parallel lines (e.g. 5*a* and 5*b*).

Alternatively, the spot bonding regions 7, could also define three parallel lines between the central bonding line 4 and edges 12*a*, 12*b*, such that they form a total of six parallel lines over the entire cleaning pad 28. Any number of lines could be formed, depending on the application.

The various spot bonding regions 7 do not overlap in the lengthwise direction of the fibers of the fiber bundle 3, and thus bonding at multiple sites along the length of a single fiber does not occur. As a result, the majority of the length of the fiber on the fiber bundle 3 is free. Because the fiber bundle 3 is strategically unimpeded, this effectively prevents entanglement of the fibers of the fiber bundle 3, while also allowing increased foreign matter trapping and retaining capacity to be maintained over a longer period of time.

Although the fibers of the fiber bundle 3 can take a variety of lengths, in the preferred embodiment, the lengths of the fibers from the central bonding line 4 to the ends of the fibers in the lengthwise direction of the fibers is preferably 50-100% of the length from the central bonding line 4 to the edges (12*a* or 12*b*) of the base sheet 2. In one preferred embodiment, a cleaning pad 28 includes a base sheet 2 with a width of 300 mm and a length of 200 mm. Preferably, the length from the central bonding region 4 to the edge of the base sheet 2 is 100 mm, and the length of the fibers of the fiber bundle 3 is preferably between 50-100 mm.

As noted above, the material of the base sheet 2 may be a non-woven cloth sheet, paper, synthetic resin sheet, or other known material. In the illustrated embodiments, the base sheet 2 is preferably a nonwoven cloth sheet capable of trapping various types of foreign matter. Preferably, the nonwoven cloth used for the base sheet 2, weighs between 10 to 200 g/m$^2$ and has a thickness of between 0.01-0.1 mm.

In the preferred embodiment, when a thermal-welded fiber is used for the fiber bundle 3, it is preferable for the base sheet 2 to have thermal welding capacity conducive to bonding with the fiber bundle 3. Likewise, when a nonwoven cloth sheet is used it is preferable that it be thermally weldable to the fiber bundle 3. As noted above, examples of such thermally weldable short fibers include polypropylene, polyethylene, polyethylene terephthalate and other fibers or materials in which the fibers are present in a core-sheath structure or in a side-by-side structure, thus forming composite fibers.

The nonwoven cloth sheet that is used as the base sheet 2, may be a spunless nonwoven cloth, spunlace, cloth, spunbonded nonwoven cloth, thermally bonded nonwoven cloth, air-through bonded nonwoven cloth, spot-bonded nonwoven cloth, or others. In the preferred embodiment, a spunless nonwoven cloth or thermally bonded nonwoven cloth is utilized. The nonwoven loth sheet may be formed from a single sheet, or may be formed by the lamination of multiple sheets of the same or different types.

The fiber bundle 3 used in the cleaning pad 28 may be produced by overlaying multiple fibers so that they run in the same direction, or may be formed from a fiber aggregate. In addition, the fiber bundle 3 can be partially bonded by means of welding or the likes between the various fibers. The fiber bundle 3 may include uniform fibers throughout, or may be constituted from multiple types of fiber.

The fiber bundle 3 may also be manufactured from fibers having the same, or multiple thicknesses. Likewise, the fiber bundle 3 can be formed from an aggregate in which fibers of different color are used, regardless of whether the thicknesses and types of the constituent fibers are the same or different.

As noted above, a wide variety of fibers may be used in the fiber bundle 3 including cotton, wool and other natural fibers, polyethylene, polypropylene, polyethylene terephthalate, nylon, polyacrylic and other synthetic fibers, core/sheath fibers, sea-island type fibers, side-by-side fibers and other composite fibers. Synthetic fibers and composite fibers are preferred due to their thermal welding properties. In one preferred embodiment, the tow is a bi-component fiber consisting of a polypropylene core and a polyethylene outer surface or sheath. This is particularly preferred, because both materials have superior thermal welding properties. In addition, the fibers used for the fiber bundle 3 may be formed from a crimped material produced by mechanical crimping or thermal crimping.

In one preferred embodiment, the fiber bundle 3 may be a long fiber bundle generally referred to as "tow," which is manufactured from polyethylene, polypropylene, nylon, polyester, rayon, or similar materials. The thickness of the fibers that constitutes the fiber bundle 3 is preferably between 1-18 deniers. In addition, the weight of the fiber bundle 3 is preferably between 5-30 g/m$^2$ when the thickness of the fibers is about 2 deniers.

In the preferred embodiments, the base sheet 2 and fiber bundle 3 are formed from thermally weldable materials, and the laminate of the base sheet 2 and fiber bundle 3 are heated and compressed with a hot roll to bond the two surfaces together. Alternatively, if the base sheet 2 or fiber bundle 3 are not weldable, a thermally bondable material such as hot melt adhesive can be laminated between them, or bonding can be carried out by directly applying an adhesive between the two layers.

As discussed above, the fiber bundle 3 or base sheet 2 may be coated with a chemical agent for improving foreign matter trapping performance, particularly of known allergens such as those disclosed in U.S. Pat. No. 6,777,064. Examples of such chemical agents include liquid paraffin and other mineral oils, silicone oils and nonionic surfactants.

Each of the above disclosed embodiments in FIGS. 1-8B provides a significant advantage over known prior art cleaning pads. Specifically, the disclosed embodiments provide for a cleaning pad 28 that does not require a separate holding or retaining sheet to couple the cleaning pad 28 to a cleaning tool handle 24.

The cleaning pads 28 are versatile in that they can be used for multiple cleanings and multiple surfaces. Each cleaning pad 28 is designed to clean at least one average size surface with an average debris or dust load. Pads can be changed sooner if surfaces are larger than average, or especially dirty. To determine if the cleaning pad 28 needs changing, look at the back of the cleaning surface of the cleaning pad and ascertain if the cleaning surface is saturated with dust and/or dirt.

To maximize the synergy between the various cleaning and dusting tasks, the present methods can be carried out using several varying executions and instructions for use. In one embodiment, a kit can be provided that has multiple cleaning pads 28 and solutions for different cleaning tasks. One solution and cleaning pad 28 could be used for surface cleaning and another solution and pad 28 for dusting. The kit may be sold separately with advertising and instructions in each kit being used to explain the benefits of using the various products together.

It is understood that the component parts of handheld duster 22 described above may be manufactured and sold separately or together in the form of a cleaning system kit. A wide variety of alternative interchangeable cleaning implements may be substituted for the cleaning pad support member 26 described above.

Additionally, the handle portion 24, as described, could be eliminated completely, and a fluid reservoir could be arranged to form the handle of the cleaning system. A pivotable attachment member could be attached to the upper end of the fluid reservoir.

h. Method of Manufacture

Figure 11:
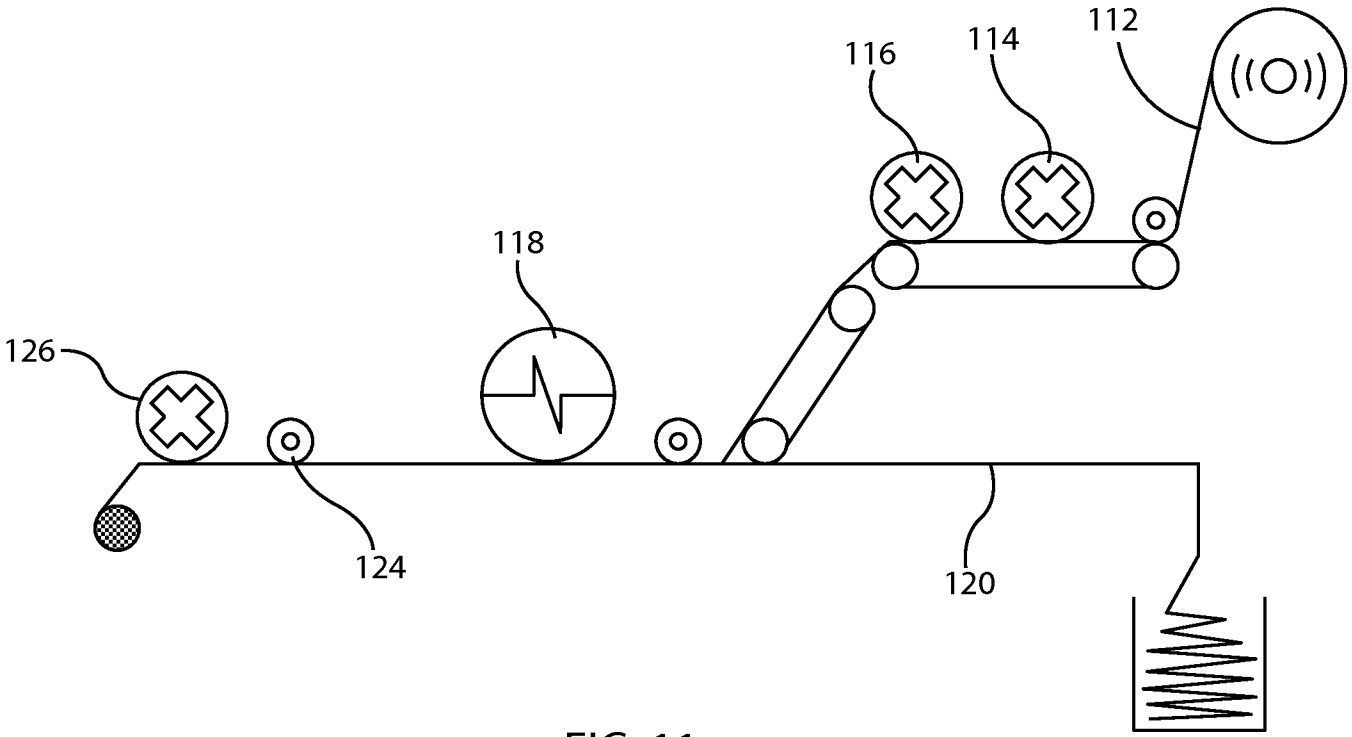
FIG. 11 is a schematic of a manufacturing process that may be used to produce the embodiments shown in FIGS. 1, 2, and 3A-D.
Figure 12:
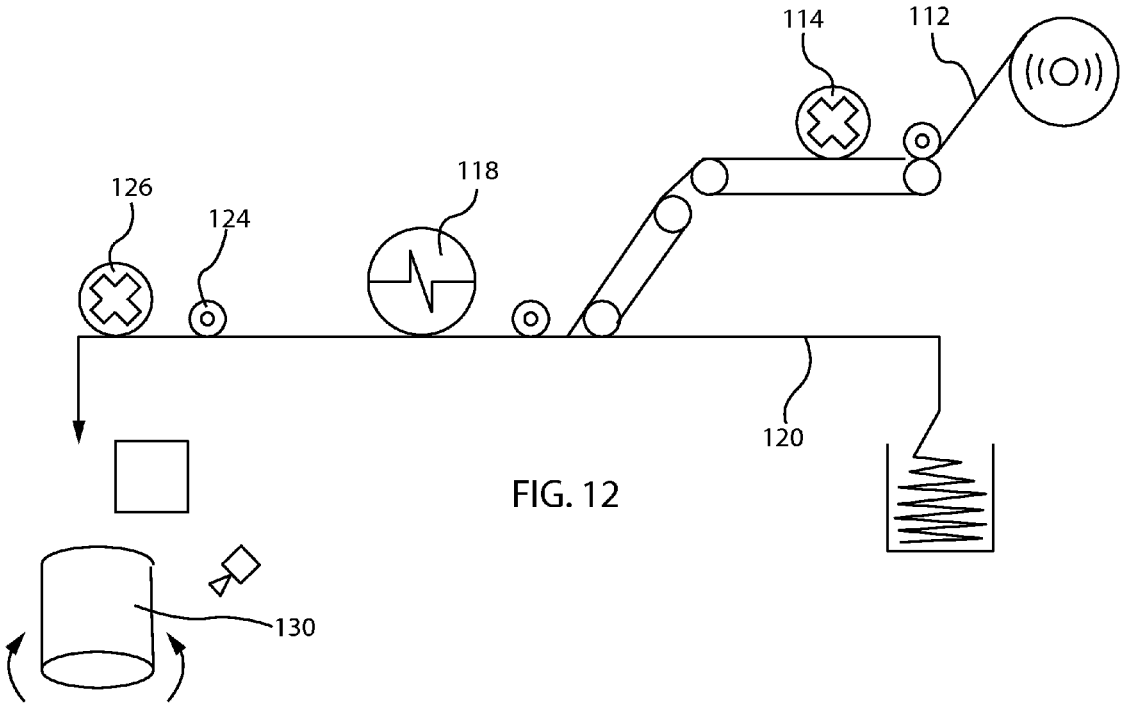
FIG. 12 is a schematic of a manufacturing process that may be used to produce the embodiment shown in FIG. 4A.

The following method of manufacture may be used to produce a cleaning pad similar to those shown in FIGS. 1, 2, and 3A-D, which is shown in FIG. 11. A continuous nonwoven sheet 112 is fed through a slit cutter 116 and then optionally through a line presser 114, as desired. The nonwoven sheet 112 is then fed through a spot and line heat seal roller 118. Tow fiber 120 is simultaneously fed to a spot and line heat seal roller 118 where the tow fiber 120 is joined to the nonwoven sheet 112. After being sealed together, the nonwoven sheet and tow fiber are passed through a pressure roller 124 until they reach a cut roller 126 which cuts the nonwoven sheet 112 and tow fiber 120 to form individual cleaning pads.

The following method of manufacture may be used to produce a cleaning pad similar to the pad of FIG. 4A. A continuous nonwoven sheet 112 may then be fed through a line presser 114, if desired. The sheet 112 then continues to a spot and line heat seal roller 118. Tow fiber is simultaneously fed to the spot and line heat seal roller 118, where the tow fiber is joined to the nonwoven sheet. After being sealed together, the nonwoven sheet and tow fiber are passed through a pressure roller 124 until they reach a cut roller 126, which cuts the nonwoven sheet and tow fiber. The cut sheets are then passed to a vacuum roll 130 where the arms are sealed together using a glue gun.

Figure 15:
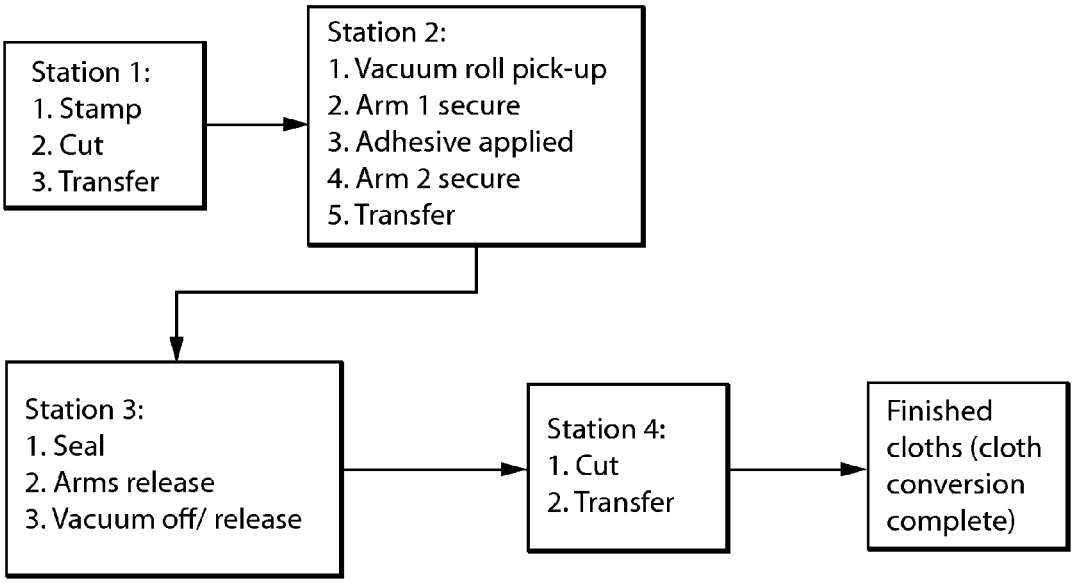
FIG. 15 is a flow chart for a manufacturing process that may be used for the embodiment shown in FIG. 4A.
Figure 16:
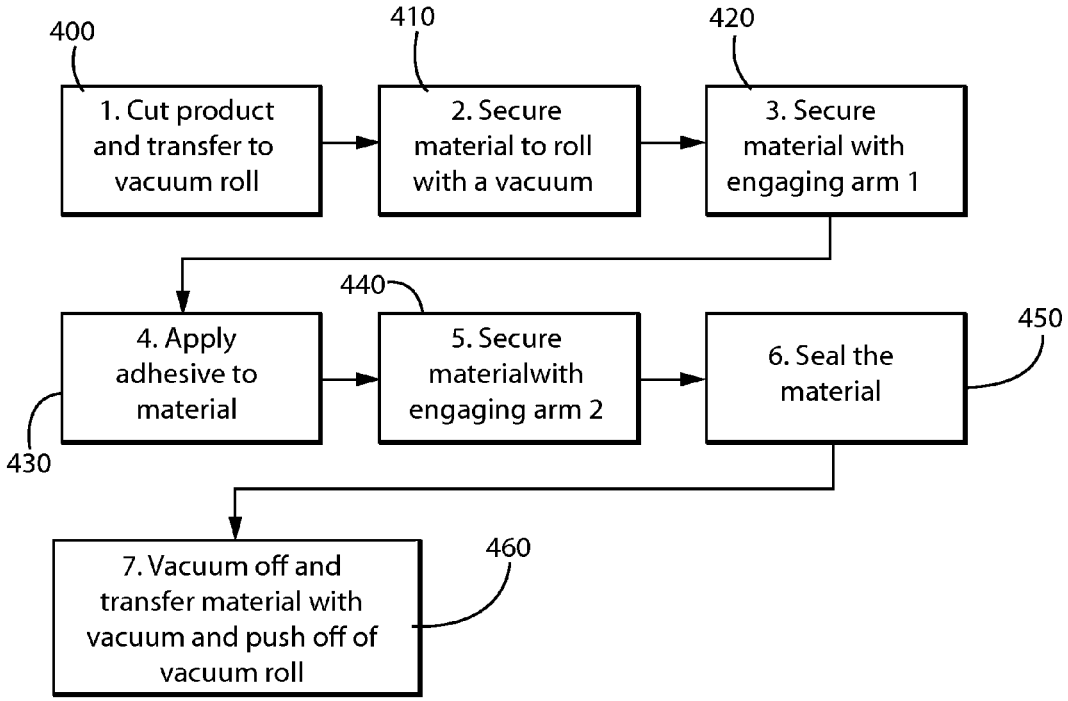
FIG. 16 is a flow chart for a manufacturing process that may be used for the embodiment shown in FIGS. 4A-B and many of the other embodiments.

More specifically, and as set forth in the flow chart of FIG. 16, the sheet is cut and transferred to a vacuum roll (step 400) and then secured to the vacuum roll using a vacuum (step 410). The sheet is further secured using a first engaging arm (step 420). An adhesive is then applied, e.g., using a glue gun, to the sheet (step 430). Similarly, a second arm then secures another portion of the sheet (step 440) and the material is then sealed (step 450). The vacuum is turned off and the finished sheet is pushed off of the vacuum roll (step 460). This process is further illustrated in the flow charts shown in FIG. 15 which groups the process steps into various stations at which the steps may take place.

Figure 13:
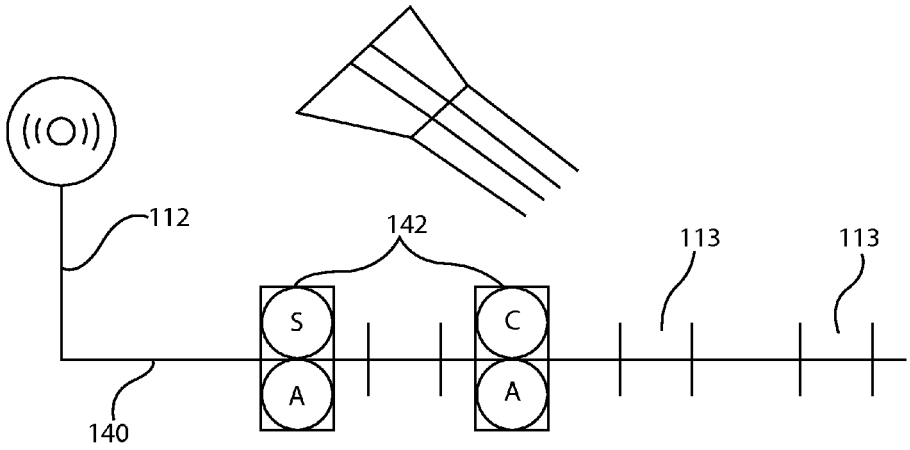
FIG. 13 is a schematic of a manufacturing process that may be used to produce the embodiments shown in FIGS. 5A-C and 6A-D.
Figure 14:
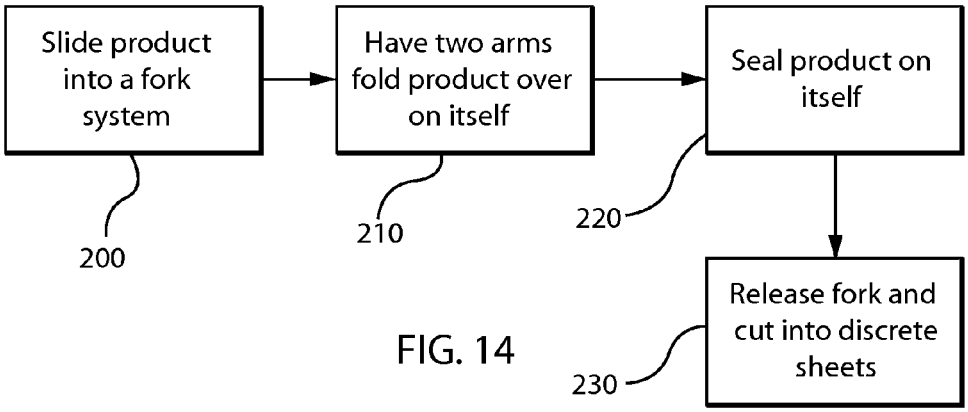
FIG. 14 is a flow chart for a manufacturing process that may be used for the embodiment shown in FIG. 4C.

With respect to the cleaning pad of FIG. 4C, the flow chart of FIG. 14 provides a general manufacturing process that may be used that is similar to the process shown shown in FIG. 13 comprising the following steps. In step 200, a nonwoven sheet 112 is fed over folding boards 140, where it is then folded in step 210. Then, the sheet 112 is passed through seal bars 142, 142, the first of which seals the sheet in step 220 and the second of which cuts the nonwoven sheet 112 into discrete sheets 113, 113 in step 230.

The following method of manufacture may be used to produce a cleaning pad, which includes the steps of: feeding a first non-woven sheet through a line presser, if desired; joining a first layer of tow fiber to the first non-woven sheet at a spot and line heat sealer; passing the first non-woven sheet and the first layer of tow fiber through a heat cutter; and cutting the first non-woven sheet and the first tow fiber to form an individual cleaning pad. The method may further comprise the step of cutting slits in the first non-woven sheet.

Further steps may include rolling the individual cleaning pad using a vacuum roller, securing the cleaning pad in the shape of a tube using an adhesive, and heat sealing the tube to itself to form two retaining cavities.

Still further steps may include heat sealing a second non-woven sheet to the first non-woven sheet and heat sealing a second layer of tow fiber to the second non-woven sheet. Still further steps may include heat sealing a third layer of tow fiber to the first layer of tow fiber and heat sealing a fourth layer of tow fiber to the second layer of tow fiber.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

Moreover, as noted throughout the application, the individual components need not be formed in the disclosed shapes, or assembled in the disclosed configuration, but could be provided in virtually any shape and assembled in virtually any configuration so as to provide for a cleaning system that includes a cleaning fluid reservoir attached to a cleaning implement support. Furthermore, all the disclosed features of each disclosed embodiment can be combined with, or substituted for, the disclosed features of every other disclosed embodiment except where such features are mutually exclusive.

We claim:

1. A method for manufacturing a cleaning pad comprising the steps of:

feeding a first non-woven sheet through a line presser;

joining a first layer of tow fiber to the first non-woven sheet at a spot and line heat sealer; and cutting the first non-woven sheet and the first tow fiber to form an individual cleaning Pad.

2. The method for manufacturing a cleaning pad according to claim 1, further comprising the step of cutting slits in the first non-woven sheet.

3. The method for manufacturing a cleaning pad according to claim 1, further comprising the step of passing the first non-woven sheet and the first layer of tow fiber through a heat cutter.

4. The method for manufacturing a cleaning pad according to claim 1, further comprising the steps of:

rolling the individual cleaning pad using a vacuum roller; and securing the cleaning pad in a tube shape using an adhesive.

5. The method for manufacturing a cleaning pad according to claim 4, further comprising the step of heat sealing the tube to itself to form two retaining cavities.

6. The method for manufacturing a cleaning pad according to claim 5, further comprising the step of:

heat sealing a second layer of tow fiber to the tube.

7. The method for manufacturing a cleaning pad according to claim 1, further comprising the steps of:

folding the non-woven sheet to form a retaining cavity; and scaling the non-woven sheet in a folded position.

* * * * *